US011142901B2

(12) United States Patent
Friedlos et al.

(10) Patent No.: US 11,142,901 B2
(45) Date of Patent: Oct. 12, 2021

(54) WALL SYSTEM

(71) Applicant: Falkbuilt Ltd., Calgary (CA)

(72) Inventors: Christoph Friedlos, Foothills (CA); Mogens Falk Smed, Foothills (CA); Dale R. Marshall, Foothills (CA); Jesse Van Mastrigt, Calgary (CA); Clayton Smed, Calgary (CA); Tara Murray, Calgary (CA)

(73) Assignee: Falkbuilt Ltd., Calgary (CA)

( * ) Notice: Subject to any disclaimer, the term of this patent is extended or adjusted under 35 U.S.C. 154(b) by 0 days.

(21) Appl. No.: 16/814,290

(22) Filed: Mar. 10, 2020

(65) Prior Publication Data

US 2020/0318339 A1 Oct. 8, 2020

Related U.S. Application Data

(60) Provisional application No. 62/828,823, filed on Apr. 3, 2019.

(51) Int. Cl.
*E04B 1/24* (2006.01)

(52) U.S. Cl.
CPC .... *E04B 1/2403* (2013.01); *E04B 2001/2415* (2013.01); *E04B 2001/2448* (2013.01)

(58) Field of Classification Search
CPC ..... E04B 1/2403; E04B 2001/2415; E04B 2001/2448; E04B 2002/7483; E04B 2/7457; E04B 2/7437; E04B 2002/7466; E04B 2002/7462; E04B 2/765; E04B 2002/7487; E04B 2/789; E04B 2/768; E04B 2002/749
See application file for complete search history.

(56) References Cited

U.S. PATENT DOCUMENTS 4,193,233 A * 3/1980 VandenHoek ..... E04B 2/7422 52/126.4
5,377,466 A * 1/1995 Insalaco ..... E04B 2/7437 160/135

(Continued)

FOREIGN PATENT DOCUMENTS

WO WO-2012039678 A1 * 3/2012 ..... E04B 1/2403

OTHER PUBLICATIONS

Murray, Tara; "Solid Wall Patent Background"; Haworth; Mar. 13, 2020; 7 pages.

(Continued)

*Primary Examiner* — Rodney Mintz
(74) *Attorney, Agent, or Firm* — Amy Fiene; Tyler Jeffs; Fabian VanCott

(57) ABSTRACT

A wall system includes at least one of a stud assembly, a top connector assembly, and a leveler assembly. The stud assembly is defined by a first and second upright that are attached by at least one web bracket. The web bracket includes a main body with extension arms on opposing sides. A notch is located at or near a free end of each extension arm. The notches are to be removably inserted over an edge of a respective aperture located on each of the first and second uprights. The top connector assembly includes a holder member to effectively raise and lower a top portion of the stud assembly. The leveler assembly includes a threaded rod to effectively raise and lower the first and second uprights relative to a base.

20 Claims, 28 Drawing Sheets

(56) References Cited

U.S. PATENT DOCUMENTS 5,606,836 A * 3/1997 Insalaco ..... E04B 2/7437 52/489.1
6,109,461 A * 8/2000 Kluge ..... A47B 57/30 211/103
6,112,485 A * 9/2000 Beyer ..... E04B 2/7437 52/239
6,349,516 B1 * 2/2002 Powell ..... E04B 2/7437 52/220.7
6,711,871 B2 * 3/2004 Beirise ..... E04B 2/7425 211/94.01
6,889,477 B1 * 5/2005 Kottman ..... E04B 2/7422 160/351
7,694,483 B1 * 4/2010 Tucker ..... E04C 3/28 52/481.1
8,015,767 B2 * 9/2011 Glick ..... E04B 2/7407 52/239
8,695,310 B2 * 4/2014 Tremblay ..... E04C 3/292 52/775
10,041,288 B1 * 8/2018 Flood ..... E04B 2/58
10,323,412 B2 * 6/2019 Koziol ..... E04F 13/081
2001/0039774 A1 * 11/2001 Beirise ..... E04B 2/7425 52/287.1
2002/0157335 A1 * 10/2002 Vos ..... E04B 2/821 52/238.1
2005/0247654 A1 * 11/2005 Walker ..... A47F 5/0846 211/94.01
2006/0236625 A1 * 10/2006 MacDonald ..... E04B 2/7425 52/239
2008/0104922 A1 * 5/2008 Glick ..... E04B 2/7425 52/630
2009/0013639 A1 * 1/2009 Tremblay ..... E04B 1/24 52/745.13
2009/0193735 A1 * 8/2009 Kalinowski ..... E04B 2/60 52/281
2016/0168863 A1 * 6/2016 Kwan ..... E04F 13/0805 52/36.5
2018/0094431 A1 * 4/2018 Koziol ..... E04B 2/7453
2021/0079648 A1 * 3/2021 Viebahn ..... E04B 2/768
2021/0180315 A1 * 6/2021 Marshall ..... E04B 2/56

OTHER PUBLICATIONS

Author unknown; Teknion Leveler Foot Image; 1 page; Retrieved from online search in Apr. 2019.

* cited by examiner

WALL SYSTEM

BACKGROUND

Digitized wall systems provide innovative solutions over drywall installation by providing manufactured wall components to be used for quick and efficient onsite installation.

DETAILED DESCRIPTION

Figure 1:
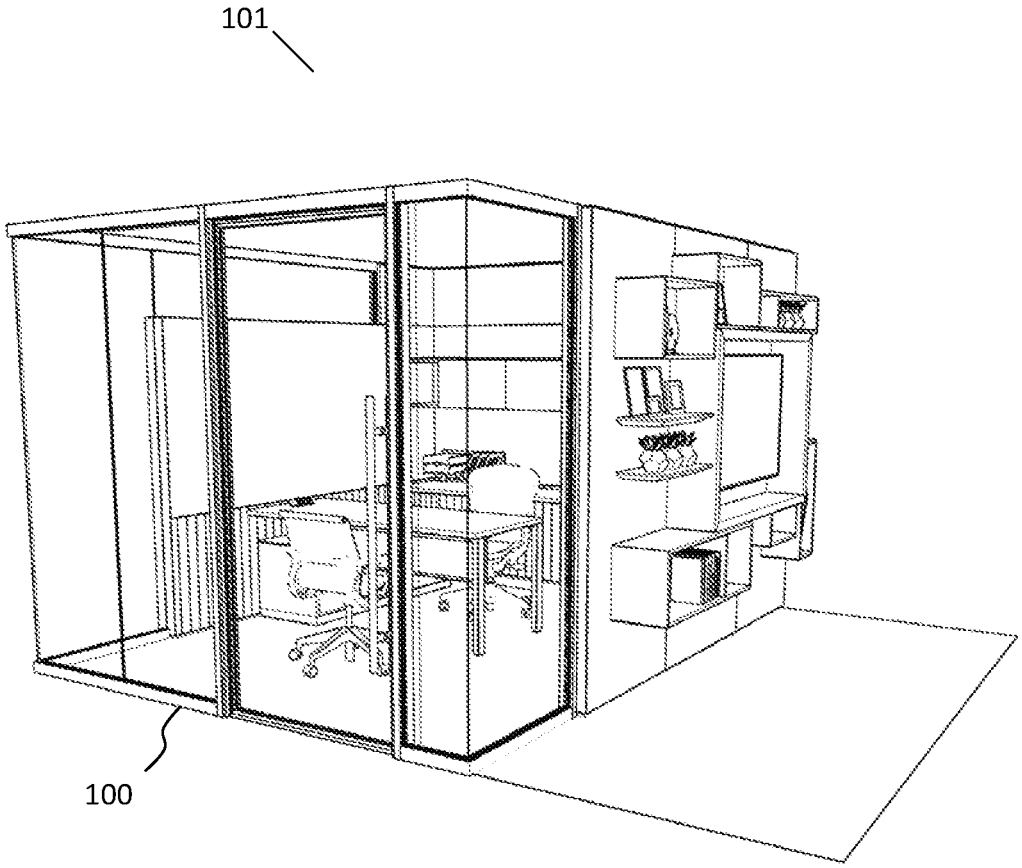
FIG. 1 illustrates a perspective view of a wall system according to an example of the principles described herein.

This application claims priority to U.S. Provisional Application 62/828,823 filed on Apr. 3, 2019.

Construction projects may involve the purchase and delivery to a job site of 30% more materials than what is needed. These projects rely on materials/tools such as screw guns, time, garbage bins, and a laborer to fill the garbage bins with waste created from the construction. When the project is completed, the bin is hauled to a dump.

In another example referred to as modular construction, everything is built in a factory, loaded in trucks, and then taken to a jobsite. After the walls or room modules are unloaded, the modules are placed side-by-side in precisely designated locations and orientations. Each module is then individually leveled and attached to adjacent modules.

The present specification describes a construction method that combines aesthetics with high-performing and cost-effective environments. Work spaces, classroom settings, and hospital rooms are just a few examples of environments in which these construction methods may be used.

The present specification describes digital component construction. Using digital technology, individual components are precisely manufactured and then delivered and installed. There is no need, however, for clean up or waste removal. The cost remains competitive with other types of construction.

As part of a digital component construction, a wall system is assembled using various components that will be described herein. The various components described herein include a stud assembly, bracket assembly, leveler assembly, a top connector assembly, and a hanger assembly.

In an example, a wall system includes a first and second upright, each upright having an elongate member. A plurality of apertures are spaced on a side surface along a longitudinal length of both the first and second upright. The wall system further includes a web bracket to connect the first and second upright, the web bracket having a central body with an extension arm on opposing sides of the central body. A notch is located at or near a free end of each extension arm. A stud assembly of the wall system is formed by the first upright connected to the second upright by a notch on either extension arm of the web bracket removably inserted over an edge of a respective aperture of the plurality of apertures of the first and second uprights.

In another example, a wall system includes a first and second upright that form a stud assembly. A top connector assembly attaches to a top portion of the first and second uprights. The top connector assembly includes a holder member to be raised and lowered relative to the stud assembly to effectively extend a top of the stud assembly. The wall system further includes a leveler assembly that includes a leveler foot that attaches to a bottom portion of the first and second uprights. The leveler assembly further includes a threaded rod attached to the leveler foot and the stud assembly, the threaded rod to raise and lower the first and second uprights relative to the leveler foot to thereby adjust a relative height of the stud assembly.

In another example, a wall system includes a stud assembly, a top connector assembly, and a leveler assembly. The stud assembly includes a first and second upright, each upright having a plurality of apertures spaced on a side surface along respective longitudinal lengths of the first and second uprights. The stud assembly further includes a web bracket having a central body with an extension arm on opposing sides of the central body, a notch located at or near a free end of each extension arm. The stud assembly is formed by the first upright connected to the second upright by the web bracket, each notch of the web bracket removably inserted over an edge of a respective aperture of the plurality of apertures of the first and second uprights.

The top connector assembly of the example wall system includes a top connector that attaches to a top portion of the first and second uprights. The top connector assembly includes a holder member to be raised and lowered relative to the stud assembly to effectively extend a top of the stud assembly.

The leveler assembly of the wall system includes a leveler foot that attaches to a bottom portion of the first and second uprights. A threaded rod is attached to the leveler foot to raise and lower the first and second uprights relative to the leveler foot to thereby adjust a relative height of the stud assembly.

FIG. 1 illustrates an example workspace 101 with a wall system 100 according to principles discussed herein. The workspace 101 includes office furniture, equipment, and décor like what is found in standard workspaces. The difference in the workspace 101 is in the construction of the walls that define the workspace 101. Digitized walls are pre-formed? making construction more efficient. The pre-formed walls are then connected using various stud assemblies and components that allow for adjustments, replacement, and overall modularity of the wall system 100.

Figure 2:
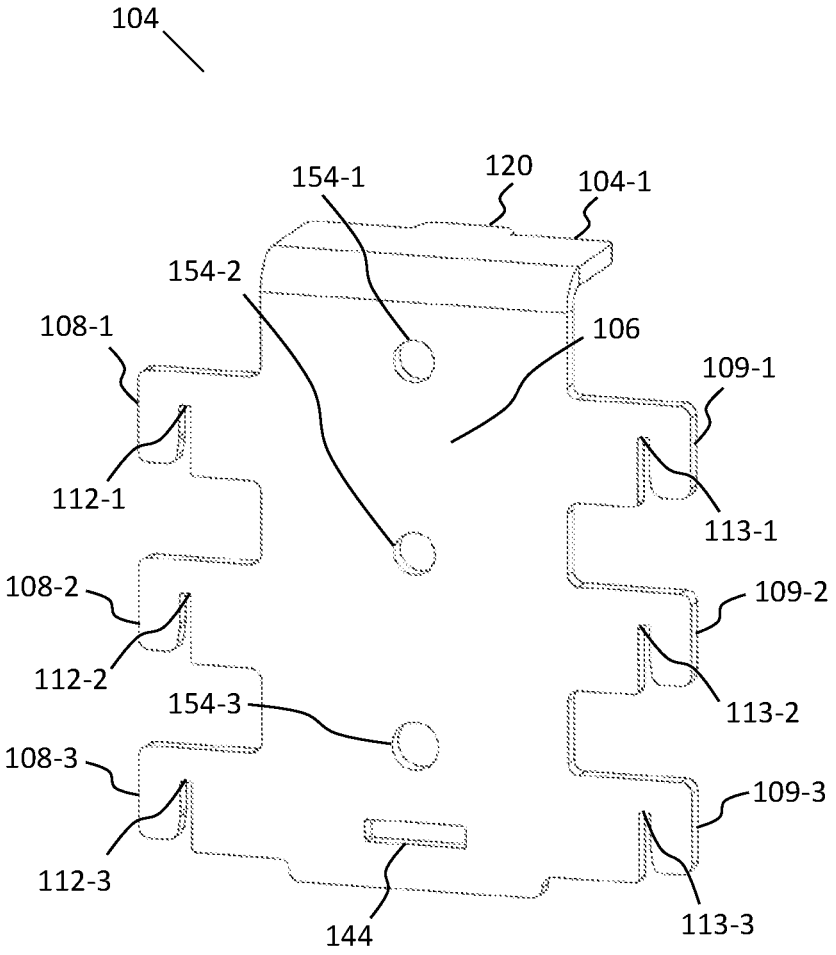
FIG. 2 illustrates a perspective view of a web bracket according to an example of the principles described herein.

Turning to FIG. 2, an example of a web bracket 104 is shown according to principles described herein. The web bracket 104 is a generally flat member with a top flange 120 that bends perpendicularly away from the flat member. Web bracket 104 includes a central body 106 that is a generally flat rectangular member. At least one conduit hole may be present for electrical or attachment purposes. As shown, holes 154-1, -2, and -3 are present. Below the holes 154-1, -2, and -3 is an elongated slot 144 that is used to receive a top flange from another web bracket as will be described in greater detail below.

On either side of central body 106 is at least one appendage that is used to connect the web bracket to upright 102 and 103. As shown, example extension arms 108-1, -2, -3, and 109-1, -2, -3 extend perpendicularly away from the central body 106 on opposing sides of the central body 106. With reference also to FIG. 2, extension arms 108-1, -2, -3, and 109-1, -2, -3 are symmetrically arranged on either side of the central body 106 and positioned such that notches 112-1, -2, -3 and 113-1, -2, -3 on the plurality of extension arms 108-1, -2, -3, and 109-1, -2, -3 are removably inserted over edges of respective apertures 116-1, -2, -3, -4 and 117-1, -2, -3, -4 of the first and second upright to form stud assemblies 124-1, -2.

Each arm 108-1, -2, -3 is a mirror image to a respective opposing arm 109-1, -2, -3 around a central longitudinal axis of the central body 106. Each arm 108-1, -2, -3, and 109-1, -2, -3 includes a rectangular or square member that is flat like the central body 106 and includes a respective notch 112-1, -2, -3, and 113-1, -2, -3 that extends perpendicularly upward from a bottom of the rectangular or square member. Each notch 112-1, -2, -3, and 113-1, -2, -3 is located at least half way, or greater than half way, from side edges of the central body 106 along the perpendicular length of the respective arm 108-1, -2, -3, and 109-1, -2, -3. The end of the arm 108-1, -2, -3, and 109-1, -2, -3 on the other side of the notch 112-1, -2, -3, and 113-1, -2, -3 is a finger like member that is slightly shorter than the rest of the arm 108-1, -2, -3, and 109-1, -2, -3 and has rounded edges at the corners to facilitate easy entry of the finger like member into a given aperture as well as its removal.

Figure 3:
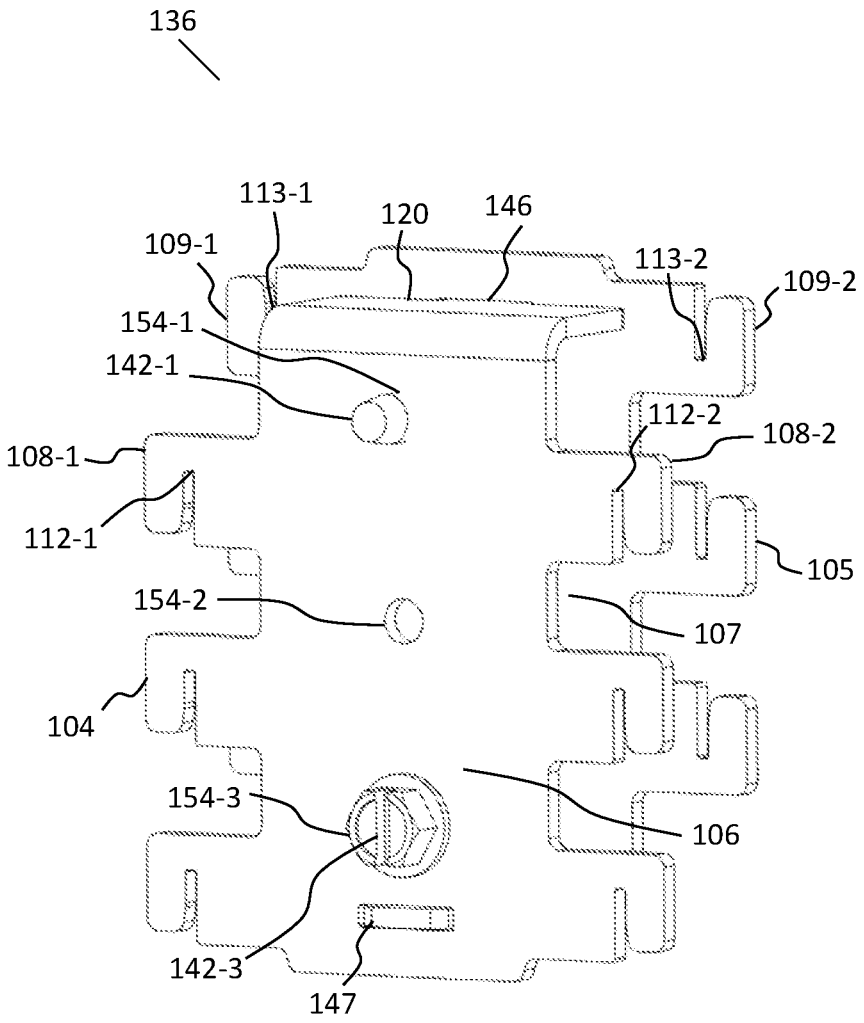
FIG. 3 illustrates a perspective view of a bracket assembly according to an example of the principles described herein.

FIG. 3 illustrates a bracket assembly 136 that includes two brackets 104 and 105 that are joined together. The brackets 104 and 105 are identical, however, bracket 104 is positioned vertically upright while bracket 105 is rotated 180 degrees to be in an inverted position. Brackets 104 and 105 each include a plurality of extension arms with respective notches, however, only the top extension arms are labeled and referenced for purposes of discussion. Note that the number of extension arms may vary. Bracket 104 includes extension arms 108-1, -2 with respective notches 112-1, -2. Bracket 105 includes extension arms 109-1, -2 with respective notches 113-1, -2. With the inverted relationship, extension arms 108-1, -2 point relatively downward while extension arms 109-1, -2 point relatively upward. In this manner, notches 112-1, -2 of extension arms 108-1, -2 engage with lower edges of respective apertures of an upright, while notches 113-1, -2 engage with upper edges of respective apertures of an upright. The lateral edges of apertures that contact lateral portions of the extension arms 108-1, -2 and 109-1, -2 restrict lateral movement of the studs. Thus, the bracket assembly attached to opposing studs restricts movement in three orthogonal axes, such as three axes in a three-dimensional cartesian coordinate system, referred to herein as three axes.

Web brackets 104 and 105 are interlocked together at a top and bottom of respective central bodies 106 and 107. Attachment structure may be included to interlock a first web bracket and a second web bracket together to form a bracket assembly 136, the bracket assembly 136 to attach the first 102 and second uprights 103 in a manner that prevents the first 102 and second uprights 103 from moving in three axes. For example, attachment structure may include one or more of screw fittings, slots, and inserts.

Figure 4:
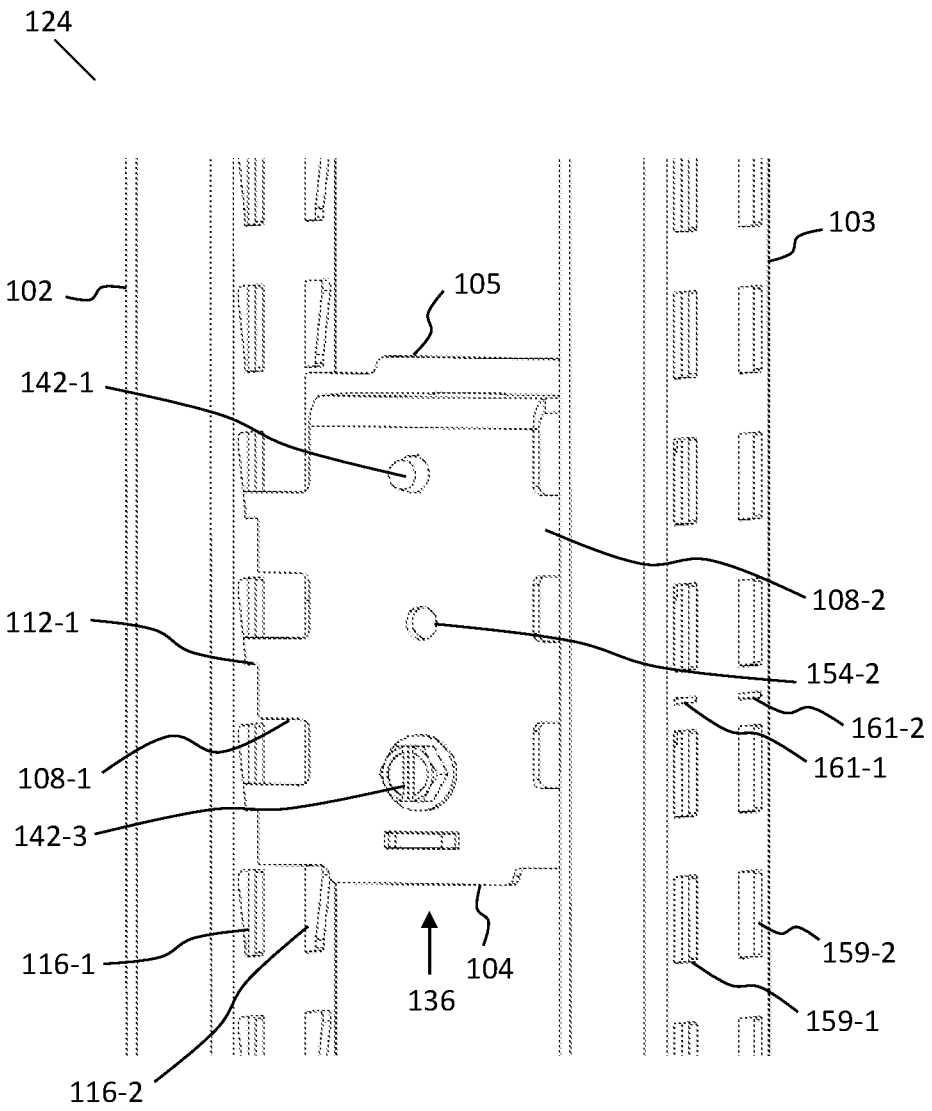
FIG. 4 illustrates a perspective view of a stud assembly according to an example of the principles described herein.

As shown, top portions of web brackets 104 and 105 include respective flanges 120 and 121 that are generally flat extended members that bend away from the central bodies 106 and 107. They may extend perpendicularly away from the central bodies 106 and 107 as shown in FIG. 4. In another example, they may extend angularly away. At free ends of the flanges 120 and 121 (see FIG. 5), inserts 146 and 147 are smaller extension of flanges 120 and 121 that further extend in a planar manner from edges of flanges 120 and 121. The inserts 146 and 147 have a shorter width than the flanges 120 and 121. They are flat extensions that are received in corresponding slots of brackets 104 and 105. Slots 144 and 145 (see FIGS. 5*a* and 5*b*) are elongated holes that are dimensioned to allow for a friction fit or otherwise slidable fit for the inserts 146 and 147. Insert 146 is received into slot 145 (see FIGS. 5*a* and 5*b*) of web bracket 105 and insert 147 is received into slot 144 (see FIGS. 5*a* and 5*b*) of web bracket 104. The web brackets 104 and 105 thus interlock to act as a single member.

The web brackets 104 and 105 are further attached with locking structure. For example, locking structure may include screws 142-1, -3 as shown. Screw 142-3 is attached through hole 154-3 with the head of the screw in front of web bracket 104. Screw 154-1 is screwed starting through web bracket 105 so that the end of the screw 154-1 is visible in front of web bracket 104. The screw may be any type of screw that can be used to attach two web brackets. For example, a Type F self-tapping screw or other type of flange head screw may be used.

FIG. 4 illustrates a bracket assembly 136 assembly to first 102 and second uprights 103 through the plurality of apertures 116-1, -2 and 117-1, -2 (see FIG. 5*b*) located along side walls of the first 102 and second uprights 103 that face each other, the pairs of apertures 116-1, -2 and 117-1, -2 being spaced in vertical increments to facilitate a variety of web bracket and web bracket sizes and positions. The pairs of apertures 116-1, -2 and 117-1, -2 may be at same or different heights relative to each other.

Apertures 116-1, -2 are spaced in pairs along the longitudinal length of the upright 116-1, -2. The apertures 116-1, -2 may have a variety of shapes, like a four-sided polygon such as the trapezoid shown. Other shapes include a parallelogram, rectangle, square, rhombus, etc. The bottom and top surface of the apertures 116-1, -2 are flat, enable a flat rest top for the engagement of notches 112-1, -2 and 109-1, -2 (see FIG. 3). Angled walls of the apertures 116-1, -2 allow the bracket assembly 136 to pivot inward and outward during insertion and removal of the bracket assembly 136 from apertures 116-1, -2.

Apertures 116-1, -2 and 117-1, -2 may be the same or different in regards to inner and outer facing surfaces of uprights. For example, the bracket assembly 136 assembled to a first 102 and second upright 103 with outer apertures 159-1, -2 on outer facing surface of second upright 103 have a rectangular shape while the inner facing surface of first upright 102 includes apertures 116-1, -2 having a trapezoid shape. The rectangular shape may be used to accommodate other components besides web brackets, for example. Corresponding outer apertures (not visible) may be located on outer facing surface of first upright 102.

Also on upright surfaces may be horizontal cutouts 161-1, -2 which include slots or holes that go through a side surface of an upright 102 or 103 and which may be used to locate other uprights. The cutouts 161-1, -2 may be located at equally spaced intervals or other types of reference intervals along the longitudinal length of a given upright surface. Example cutouts 161-1, -2 are shown located directly in line with and in between pairs of apertures 159-3, -4 on second upright 103. Corresponding example cutouts (not visible) may be located on first upright 102 as well. Instead of slots or holes, the cutouts 161-1, -2 may be indentations, visual markings, or other cues that lend usefulness to installation purposes. Instead of a pair of cutouts, there may be a single cutout at each spaced interval.

Screws 142-1, -3 go through respective holes 154-1 and 154-3 (see FIGS. 5*a* and 5*b*) of web bracket 104 as well as corresponding holes (not shown) on web bracket 105. At least one hole 154-1, -2, -3 (see FIGS. 5*a* and 5*b*) may be used for attachment of conduit holders; building interfaces; clamps for holding conduits; cables; and other wall components.

Figure 5A:
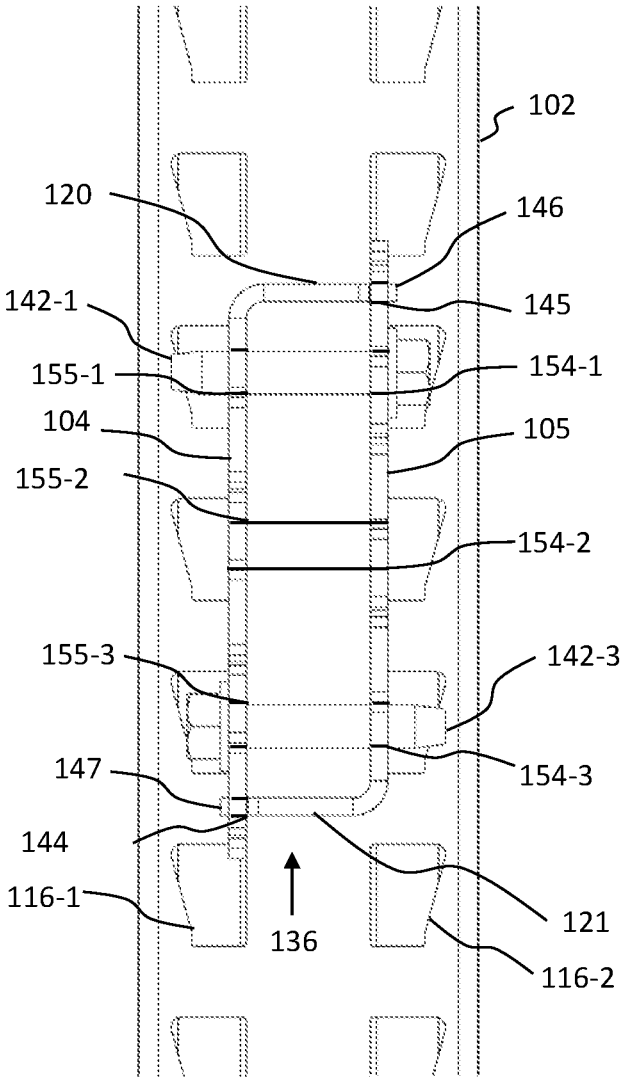
FIG. 5*a* illustrates a cutout side view of a stud assembly according to an example of the principles described herein.

FIG. 5*a* illustrates a side cutout view from the first upright side 102 of the bracket assembly 136 in FIG. 4. Web brackets 104 and 105 each include an insert 146 and 147 on one end and a slot 144 and 145 on the other side. Web bracket 104 and 105 are attached with inserts 146 and 147 received into respective slots 145 and 144. Screws 142-1, -3 further secure the engagement of web brackets 104 and 105 together. The web brackets 104 and 105 are spaced apart such that extension arms 108-1, -2 and 109-1, -2 (see FIG. 4) may be inserted within apertures 116-1, -2. The space between the pair of web brackets 104 and 105 also help to reduce rotation or other movement of uprights. The box-like cross-section of the bracket assembly 136 is stronger and more stable than a web bracket 104 and 105 acting in isolation. Note that the screws 142-1, -3 do not extend past outer edges of first upright 102. The screws 142-1, -3 may further have a width that is the same as or less than a combined width of apertures 116-1, -2.

Figure 5B:
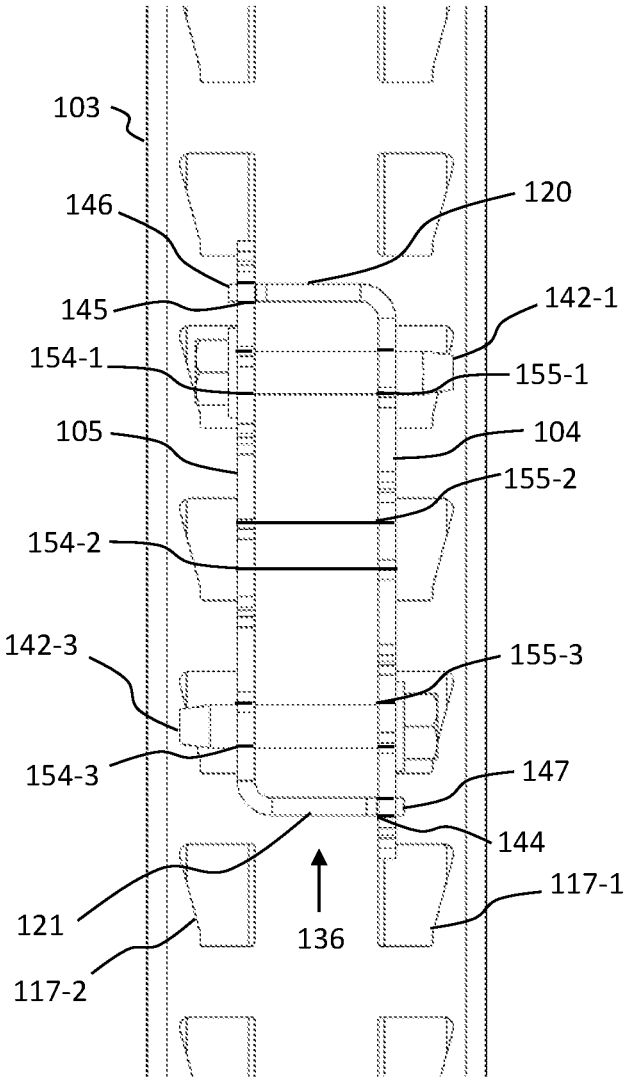
FIG. 5*b* illustrates a cutout side view of a stud assembly according to an example of the principles described herein.

FIG. 5*b* illustrates a side cutout view from the second upright side 103 of the bracket assembly 136 in FIG. 4. Web brackets 104 and 105 are attached with inserts 146 and 147 received into respective slots 145 and 144. Screws 142-1, -3 further secure the engagement of web brackets 104 and 105 together. The web brackets 104 and 105 are spaced apart such that extension arms 108-1, -2, 109-1, -2 (see FIG. 4) may be inserted within apertures 117-1, -2. The space between the pair of web brackets 104 and 105 helps to reduce rotation or other movement of uprights. The box-like cross-section of the bracket assembly 136 is stronger and more stable than a web bracket 104 and 105 acting in isolation. Note that the screws 142-1, -3 do not extend past outer edges of first upright 102. The screws 142-1, -3 may further have a width that is the same as or less than a combined width of apertures 116-1, -2.

The separation of uprights 102 and 103 as connected by the bracket assemblies, such as bracket assembly 136, provides dead space that results in a reduction of sound transfer and provides a greater Sound Transmission Class (STC). This situation is analogous to a split/offset upright construction which reduces the heat transfer in an exterior wall system. Uprights 102 and 103 having a hollow therethrough to further provide a reduction of sound transfer.

Figure 6:
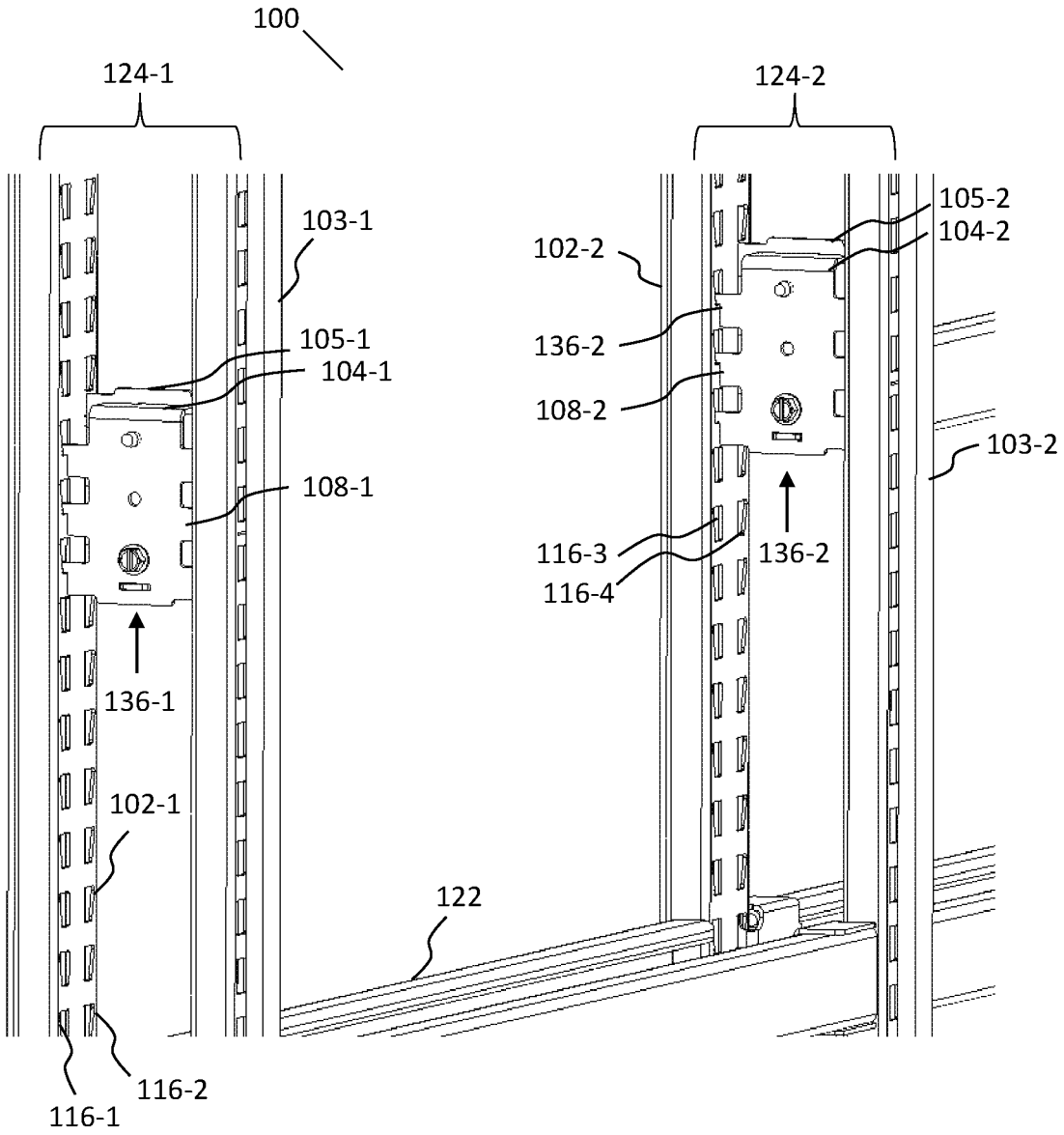
FIG. 6 illustrates two stud assemblies according to an example of the principles described herein.

Turning to FIG. 6, a portion of a wall system 100 is shown having two stud assemblies 124-1, -2 connected by a crossbar 122. Each first upright 102-1, -2 and each second upright 103-1, -2 includes an elongate member with a hollow therethrough along respective longitudinal lengths. The hollow may have a rectangular or square cross section, for example. While first and second uprights 102-1, -2 are shown being vertical with respect to a ground surface or to a leveler assembly, the orientation may instead be horizontal or angular.

With reference also to FIG. 2, stud assemblies 124-1, -2 are formed by the first uprights 102-1, -2 connected to the respective second uprights 103-1, -2 by the respective web brackets 136-1, -2 of the bracket assembly 136-1, -2. A plurality of apertures 116-1, -2, -3, -4 are spaced on side surfaces along the longitudinal lengths of first 102-1, -2 uprights. Corresponding apertures (not visible) are located on second uprights 103-1, -2 (see apertures 117-1, -2 on second upright 103 in FIG. 5*b*). Each bracket assembly 136-1, -2 includes respective extension arms 108-1, -2 with notches (see FIG. 3) that are removably inserted over edges of a respective apertures 116-1, -2, -3, -4 on first upright 102 and apertures (not visible) on second upright 103 to connect respective first 102-1, -2 and second uprights 103-1, -2. The bracket assemblies 136-1, -2 can be placed at same or different heights relative to each other along the longitudinal lengths of the first 102-1, -2 and second uprights 103-1, -2. Each web bracket 104-1, -2, and 105-1, -2 is designed to be removed, relocated, and replaced without requiring any disassembly of the first 102-1, -2 or second uprights 103-1, -2, the bar connector 122, or any other component of the wall system 100. This allows stability of the framework to endure while changes are made.

Figure 7:
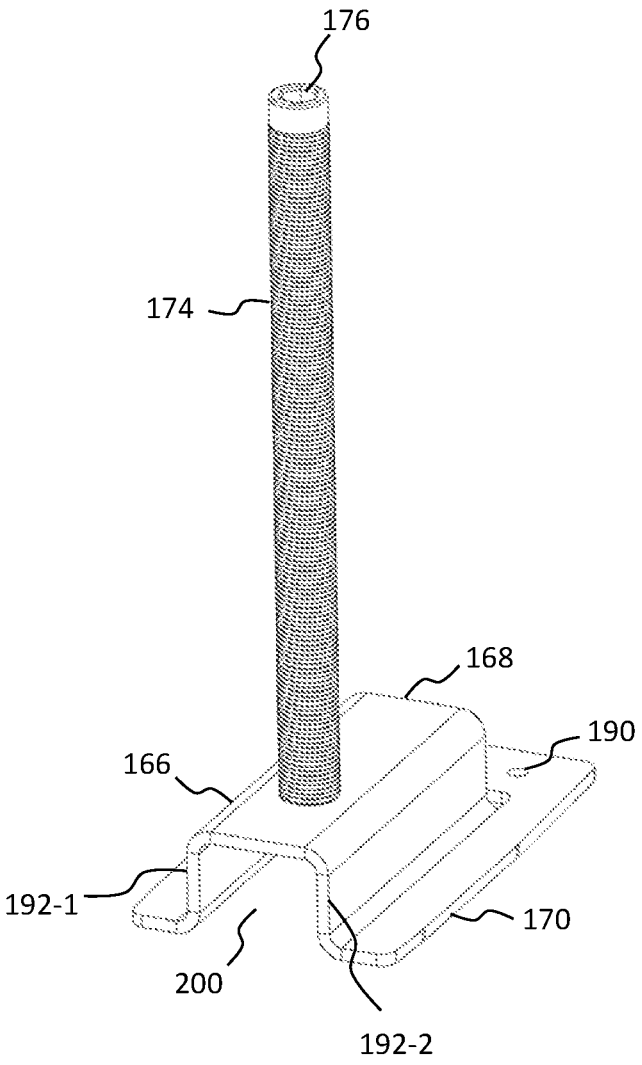
FIG. 7 illustrates a perspective view of a leveler foot and threaded rod according to an example of the principles described herein.
Figure 10:
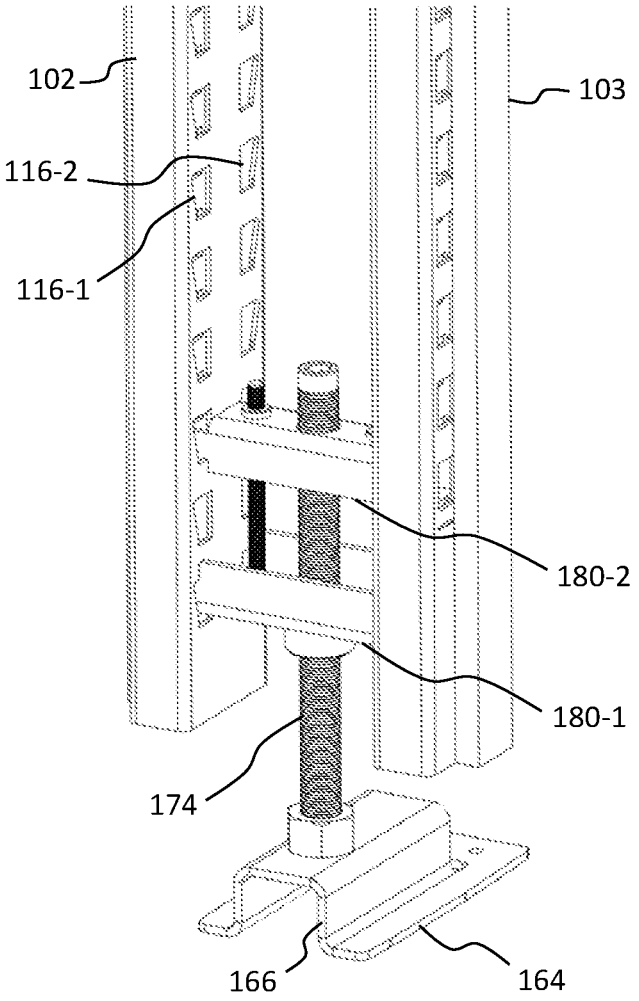
FIG. 10 illustrates a perspective view of a leveler assembly attached to uprights according to an example of the principles described herein.

Turning to FIG. 7, a threaded rod 174 is shown attached to a leveler foot 166 and is used in a leveler assembly 164 (see FIG. 10). The leveler assembly 164 is to removably attach to the first 102 and second uprights 103 at respective apertures 116-1, -2, 117-1, -2. The threaded rod 174 is to raise and lower the first 102 and second uprights 103 relative to a leveler foot 166 of the leveler assembly 164 and thereby adjust a relative height of the stud assembly 124 (see FIG. 10).

The threaded rod 174 includes screw threads that are used to raise and lower first 102 and second 103 uprights. On top of the threaded rod 174 is a central hole 176 which may be defined by an internal allen drive to allow another member to be removably received within the central hole 176. The member is to be rotated in a screw jack manner as part of the raising and lowering of the stud assembly 124.

Attached to the bottom of the threaded rod 174 is the leveler foot 166. The leveler foot 166 includes two flat surfaces that are separated from each other, including a raised base 168 and a support base 170. The raised base 168 supports the threaded rod 174 and is vertically offset from the support base 170. A space 200 is provided underneath the raised base to allow the threaded rod 174 to be lowered into when being rotated. Divider walls 192-1, -2 are generally flat side walls that join the raised base 168 and the support base 170 and extend from side edges of the raised base 168 to side edges of the support base 170. The support base 170 is a generally flat flange-like member that extends outward from ends of the divider walls 192-1, -2 and wraps around to the back of the raised base to surround at least a portion of the raised base 168.

Figure 8:
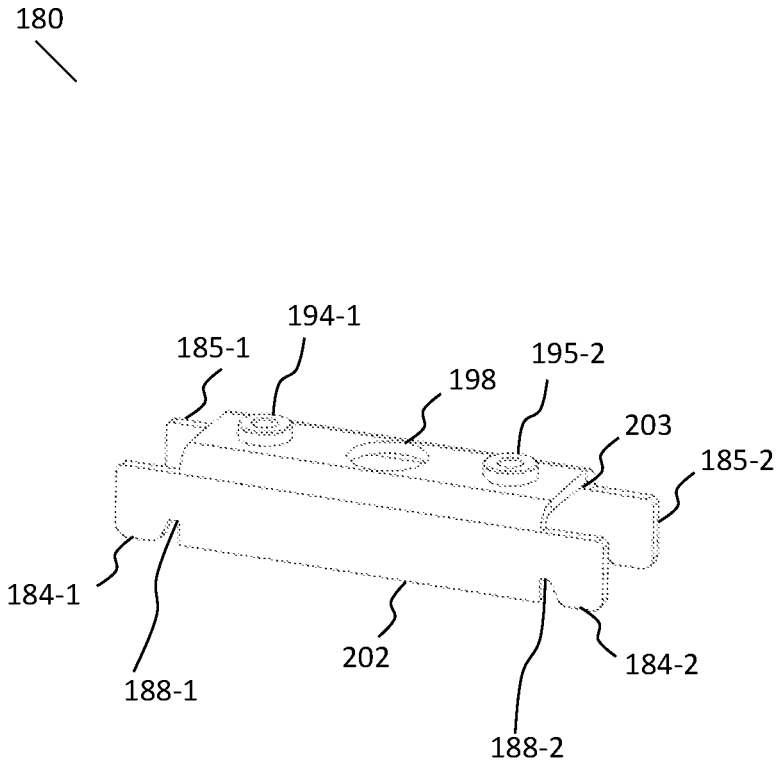
FIG. 8 illustrates a perspective view of a support bracket according to an example of the principles described herein.

FIG. 8 illustrates an example support bracket 180 to be used with the leveler assembly 164. The support bracket 180 includes an elongate body with a central hole in the elongate body for insertion of the threaded rod 174. Small holes and screws 194-1 and 195-2 on either side of the central hole 198 allow alignment and securement of the support bracket 180 and uprights 102 and 103 relative to the rest of the leveler assembly 164. Side members 202 and 203 extend perpendicularly downward from the elongate body and also extend past lengthwise edges to form outer wings 184-1, -2 and 185-1, -2. Each wing 184-1, -2 and 185-1, -2 includes a respective notch 188-1, -2 (notches not visible for wings 185-1, -2) to be removably inserted over apertures of respective uprights 102 and 103 for securement of the leveler assembly 164 to a stud assembly 124. The support bracket 180 spans a width between first 102 and second uprights 103. Notches on opposite ends of the support bracket are to engage respective apertures 116-1, -2 and 117-1, -2 on the first 102 and second uprights 103. A central hole 198 centrally located on the support bracket 180 is to allow the threaded rod 174 to be rotatably engaged to thereby raise and lower the first 102 and second uprights 103.

Figure 9:
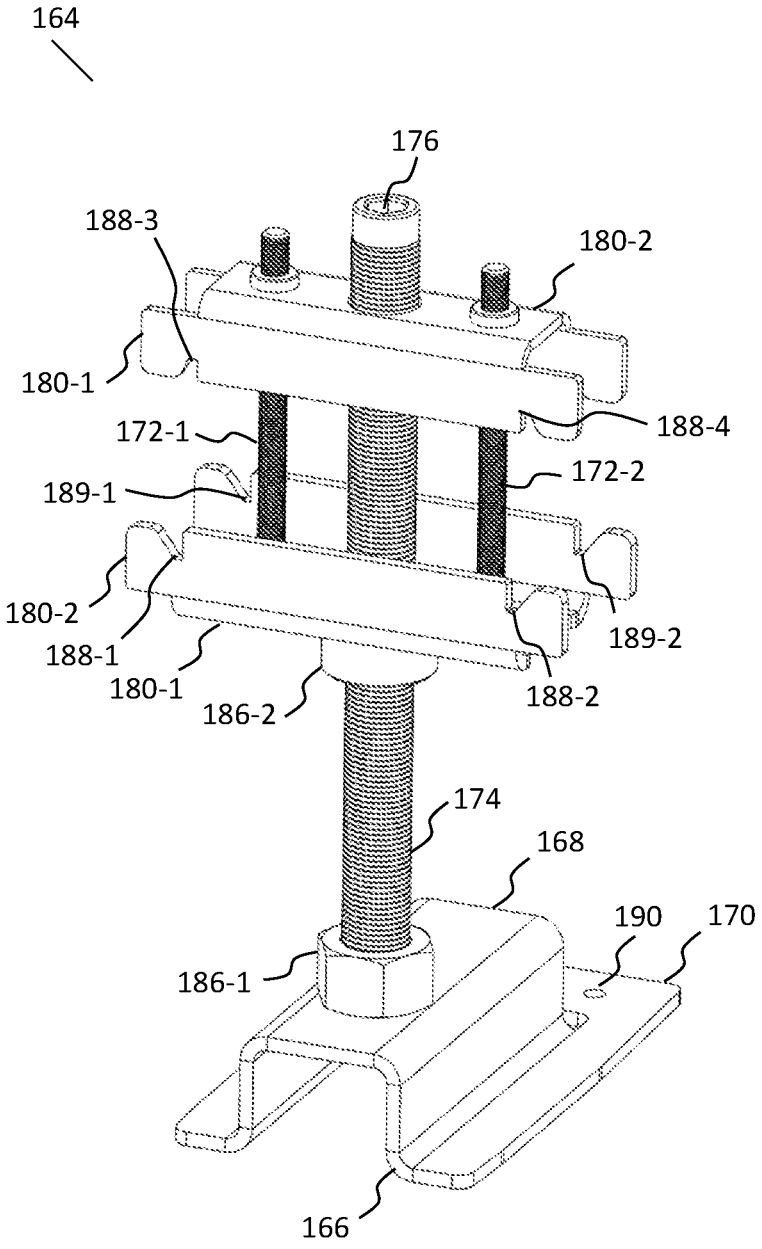
FIG. 9 illustrates a perspective view of a leveler assembly according to an example of the principles described herein.

FIG. 9 illustrates a complete leveler assembly 164. The threaded rod 174 is anchored to the raised base 168 of the leveler foot 166 with nut 186-1. Particularly, the nut 186-1 is installed on to the threaded rod 174 and staked into position on the leveler foot 166 and attached, for example, by welding or other bonding. This allows the threaded rod 174 to rotate freely about the leveler foot 166. The nut 186-1 provides a larger surface area to distribute the vertical loads and as another method to rotate the threaded rod 174 for leveling. Hole 190 may be used to screw or otherwise affix the leveler assembly to a ground surface below.

A pair of support brackets 180-1, -2 are attached to the threaded rod 174 with nut 186-2. The support brackets 180-1, -2 are attached to each other through small screws 172-1, -2. Support bracket 180-1 faces upward with notches 188-1, -2, and 189-1, -2 on top. Support bracket 180-2 faces downward with notches 188-3, -4 and back notches (not visible) on the bottom. Rotational movement relayed through the internal allen drive via the central hole 176 translates into vertical movement of the support brackets 180-1, -2, and consequently, to the uprights 102 and 103 attached to the support brackets 180-1, -2. The support brackets 180-1, -2 provide stability for translation of rotational of the threaded rod 174 to vertical movement of the first 102 and second upright 103.

FIG. 10 illustrates the leveler assembly 164 supporting first 102 and second studs 103. Support brackets 180-1, -2 are attached to apertures 116-1, -2 on first upright 102 and apertures 117-1, -2 (see FIG. 5*b*) on second upright 103. An allen wrench may be used to rotate the threaded rod 174 to raise and lower support brackets 180-1, -2 relative to the leveler foot 166 as desired or needed.

Figure 11:
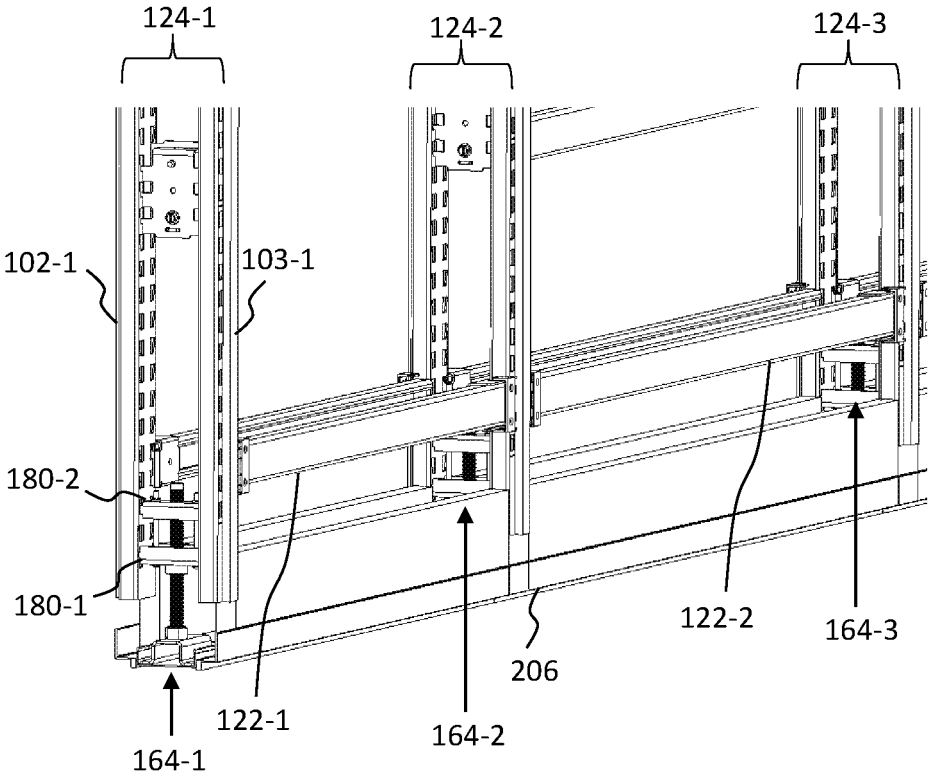
FIG. 11 illustrates a perspective view of stud assemblies and leveler assemblies on a base track according to an example of the principles described herein.

FIG. 11 illustrates a series of leveler assemblies 164-1, -2, -3 used to offset respective stud assemblies 124-1, -2, -3. Cross bars 122-1, -2 that attach to the stud assemblies 124-1, -2, -3 are also raised and lowered by the leveler assemblies 164-1, -2, -3 since they are connected to respective stud assemblies 124-1, -2, -3. Each leveler assembly 164-1, -2, -3 allows for individually distinct, both major and minute changes, such that precise positioning and leveling of upright assemblies 124-1, -2, -3 can be obtained. As shown, the upright assemblies 124-1, -2, -3 may be raised off a ground floor below to be suspended by the leveler assemblies 164-1, -2, -3.

For leveler assembly 164-1, reference is further made to FIG. 9 to show that screws 172-1, -2 are used to clamp the brackets 180-1, -2 together. They can also be adjusted to determine the individual heights of the sides of respective support brackets 180-1, -2. In this manner, each first 102-1 and second upright 103-1 can be adjusted in height and angle relative to each other. Such application also applies to leveler assemblies 164-2, -3.

Figure 12A:
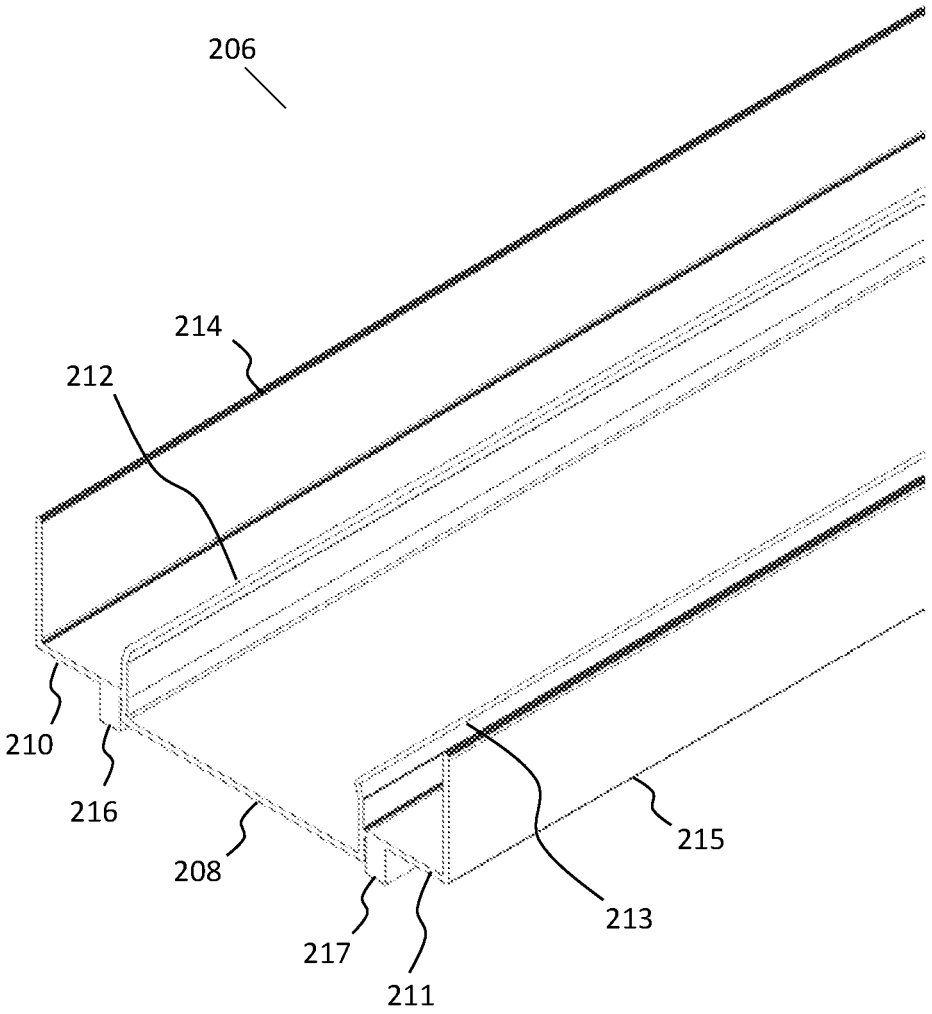
FIG. 12*a* illustrates a perspective view of a base track according to an example of the principles described herein.

As shown in FIG. 11, the ground floor may include a base track 206 that the leveler assemblies 164-1, -2, -3 are placed on to support the upright assemblies 124-1, -2, -3, as shown. The base track 206 is shown in greater detail in FIG. 12*a* and includes a flat base 208 with a stepped platform 210, 211 on either side of the flat base 208. Divider walls 212 and 213 are walls located between the flat base 208 and the stepped platforms 210, 211. The stepped platforms 210, 211 are raised a vertical height from the flat base 208, the flat base 208 being a generally flat elongate member 208. The width of the stepped platforms 210, 211 ensure that uprights 102 and 103 can be placed on top with a smooth or friction fit. End walls 214, 215 include walls that extend upward along outside edges of the stepped platforms 210, 211 and keep upright assemblies 124-1, -2, -3 in place on the stepped platforms 210, 211.

Blocks 216 and 217 are elongated blocks that span the length of the base track 206. The blocks 216 and 217 may include acoustic properties. For example, the material of the blocks 216 and 217 may be acoustical foam. Also, the material may be flexible such that it conforms to various contours and unevenness of a bottom floor or slab and thus prevents or reduces sound traveling across the wall system 100.

Figure 13:
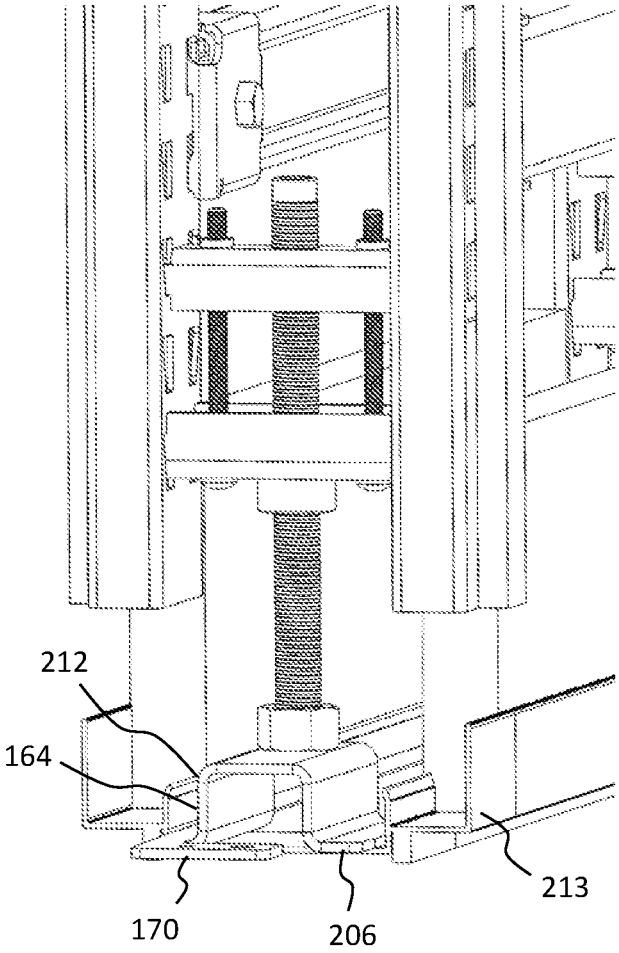
FIG. 13 illustrates a perspective view of a leveler assembly according to an example of the principles described herein.

Each divider wall 212 and 213 is a flat member that extends perpendicularly away from the flat base 208. Free ends of each divider wall 212 and 213 curve or otherwise bend inward toward a central long axis of the flat base 208, the free ends having resilient properties so as to be forced apart and then elastically returned toward their original shape to thereby allow a leveler assembly 164 to be inserted and retained. The divider walls 212 and 213 of the flat base 208 not only separate the base track 206 from the stepped platforms 210, 211, but they also help to secure the leveler assemblies 164-1, -2, -3. As shown in FIG. 13, the leveler foot 166 of the leveler assembly 164 is attached within the space defined between the divider walls 212 and 213. The support base 170 may be angled or rotated to have one end be inserted underneath a curved portion of one of the divider walls 212 or 213 and then have a snap fit with the other side so as to be fully attached between both divider walls 212 and 213.

Figure 12B:
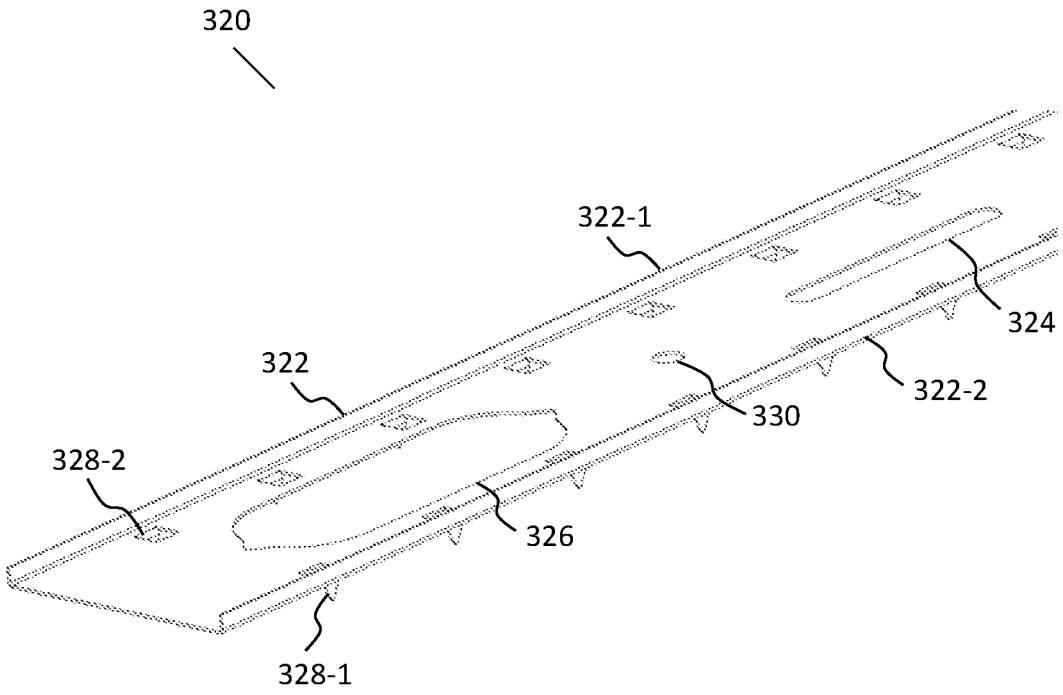
FIG. 12*b* illustrates a perspective view of a grip according to an example of the principles described herein.

In an example, a wall system 100 is to be installed over a carpet or rug with locking structure. FIG. 12*b* illustrates an example grip 320 used to attach to the material of the carpet or rug. The grip 320 includes an elongate strip member 322 that is generally flat. On either side of the strip member 322 is a wall 322-1, -2 which is a member that extends vertically or perpendicularly away from the strip member 322. The walls 322-1, -2 have a cupping shape such that the walls 322-1, -2 cup inward or otherwise curve toward a central axis along the length of the elongate strip member 322. The walls 322-1, -2 may be of a resilient material such that the walls 322-1, -2 may be forced away from the elongate strip member 322 and away from each other and then return toward their original position. The walls 322-1, -2 are used to snap to the bottom around outer facing sides of end walls 214 and 215 of the base track 206 to attach the grip 320 underneath the base track 206.

The grip 320 further includes retention elements 328-1, -2 that are spaced along outer edges of either side of the elongate strip member 322. Each of the retention elements 328-1, -2 may include at least one prong or anchor with a sharp pointed edge as shown. The pointed edges of the retention elements 328-1, -2 dig into the material of the carpet or rug. The prongs or anchors may be angled or perpendicular to the elongate strip member 322. In an example, the prongs or anchors are pressed into the material to fasten the grip 320 to the carpet or rug. In another example, the prongs or anchors may bend around the material or fibers such that the grip 320 is further fastened to the carpet or rug.

Various holes may be present along the base track 206 to allow electrical wiring to pass through or to fasten the base track to surfaces below. Example obround hole 324 and oblong hole 326 as shown may be used. Also present may be a screw hole 330 as shown for fastening the grip 320 to a carpet or rug on the bottom or the base track 206 on the top. Various surfaces that the grip 320 are attached to may include textile fabric with at least one or more materials, such as natural or manmade fibers. Also, plastic, wood, plant-based materials, naturally occurring materials, or manmade materials may be present.

Figure 14:
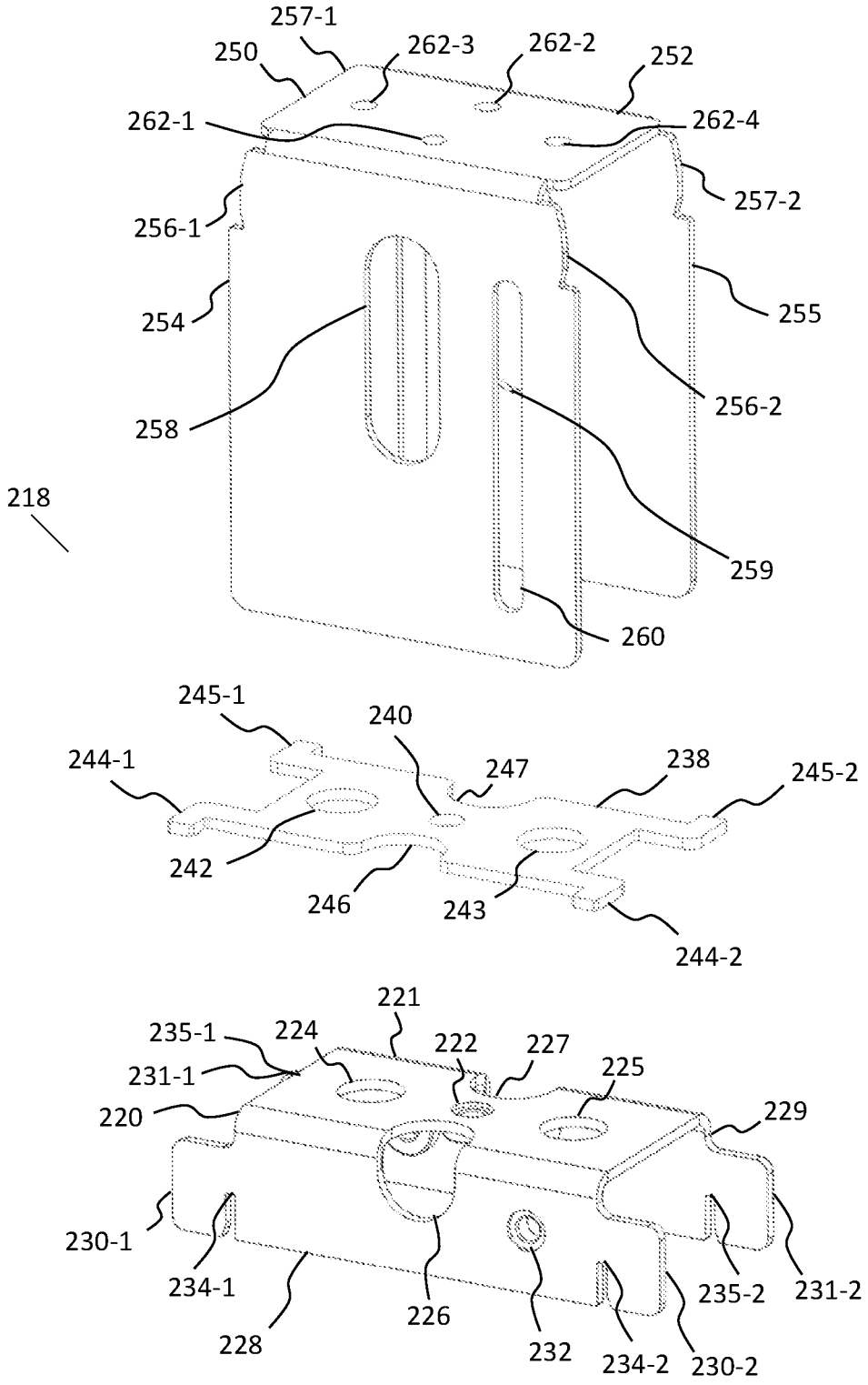
FIG. 14 illustrates an exploded view of a top connector assembly according to an example of the principles described herein.

Further to the wall system may be a top connector assembly 218 which is shown in exploded form in FIG. 14 and includes going from bottom to top, a lower bracket 220, retainer plate 238, and holder member 250. The lower bracket 220 includes a flat main body 221 with two side arms 228 and 229 that extend from opposing sides from and perpendicularly downward relative to the flat main body 221. The two side arms 228 and 229 include respective notches 234-1, -2, and 235-2 (-1 is not visible). The notches 234-1, -2, and 235-2 extend from outer edges of the two side arms 228 and 229 up to a portion, such as approximately half the vertical height, or more or less, of the side arms 228 and 229. The notches 234-1, -2, and 235-1, -2 are also in line with corner edges of the flat main body 221. Outer wings 230-1, -2, and 231-1, -2 are located on the other side of the notches 234-1, -2, and 235-1, -2 and are coplanar with side arms 228 and 229 extending past edges of the flat main body 221 along the axial length of the flat main body 221. The lower bracket 220 spans a width between the first 102 and second uprights 103 with notches 234-1, -2, and 235-1, -2 on opposite ends of the lower bracket 220 to engage respective apertures 116-1, -2, and 117-1, -2 on the first 102 and second uprights 103. The lower bracket 220 further includes a series of holes, such as a central hole 222, side holes 226 and 227, corner holes 226 and 227, and access hole 232.

The retainer plate 238 above the lower bracket 220 includes a generally flat, planar member to lay flush on a top surface of the lower bracket 220. A pair of side arms 244-1, 245-1 and 244-2, 245-2 extend from opposing ends of the flat main body 221 and attach to respective apertures 116-1, -2, and 117-1 of the stud assembly 124 for securement of the retainer plate 238 and lower bracket 220 to the stud assembly 124. The attachment of the retainer plate 238 to the stud assembly 124 prevents movement of the top connector assembly 218 relative to the stud assembly 124. Each side arm 244-1, 245-1, 244-2, 245-2 includes a flat co-planar elongate member with an end portion that bends or curves relative to the main body 221. As shown, the end portion bends perpendicularly, or in other words, at a 90 degree angle away from a central axis of the main body 221, and is to be inserted within an aperture of an upright. Cutouts 246 and 247 are half circle or otherwise rounded cutouts centrally located halfway along outer edges of the retainer plate 238 on opposing sides.

The top connector assembly 218 also includes a holder member 250 with side panels 254 and 255 to partially surround the lower bracket 220 and retainer plate 238. The side panel 254 is shown having center slot 258 and side slot 260. The holder member 250 includes a top panel 252, two side panels 254 and 255, and curved shoulders 256-1, -2, and 257-1, -2 at a top portion of the side panels 254 and 255. Curved shoulders 256-1, -2, and 257-1, -2 are to engage a top crossbar 236 (see FIG. 18). In an example, curvature of the curved shoulders 256-1, -2, and 257-1, -2 conforms to corresponding curvature of the top crossbar 236 such that the top crossbar 236 snaps onto the top crossbar 236 and is retained on the stud assembly 124. A screw (not shown) may be used to further attach the top crossbar 236 to the stud assembly. Holder member 250 further includes a series of holes, such as holes 262-1, -2, -3, -4, center slot 258, and side slot 260. While holes are just shown on side panel 254, similar or different holes may also be located on side panel 255.

Figure 15:
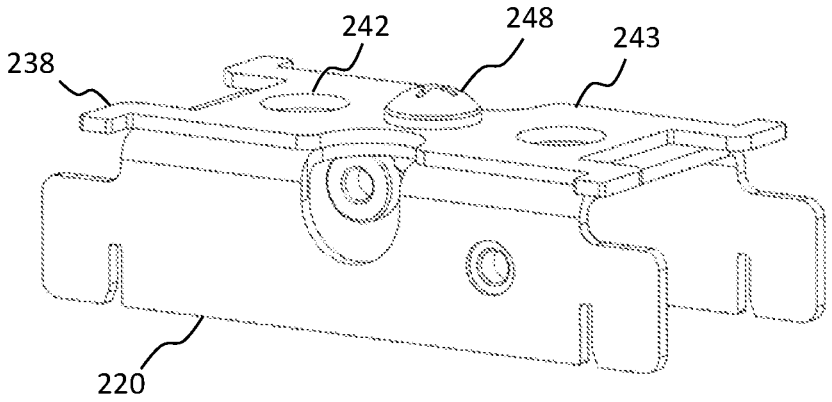
FIG. 15 illustrates a perspective view of a support bracket attached to a retainer plate according to an example of the principles described herein.

Assembly of the retainer plate 238 on the lower bracket 220 is shown in FIG. 15. Locking structure, such as screw 248 is used to attach retainer plate 238 to lower bracket 220 through central holes 240 and 222 (see FIG. 14) which are aligned.

Figure 16:
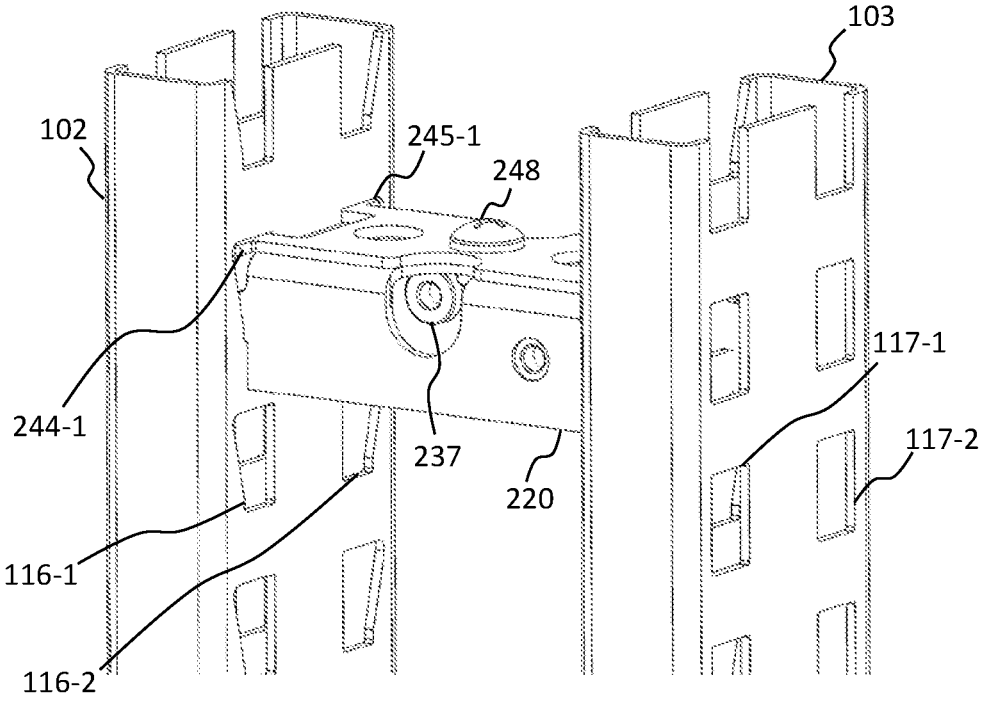
FIG. 16 illustrates a perspective view of a support bracket and retainer plate attached to uprights according to an example of the principles described herein.

Assembly of the retainer plate 238 and lower bracket 220 to first 102 and second uprights 103 is shown in FIG. 16. Side arms 244-1, -2 and 245-1, -2 (see FIG. 14) of retainer plate 238 are removably inserted in respective apertures 116-1, -2, and 117-1, -2. Also, notches 234-1, -2, and 235-1, -2 of outer wings 230-1, -2 and 231-1,-2 (see FIG. 14) are removably inserted in the apertures 116-1, -2, and 117-1, -2.

Figure 17:
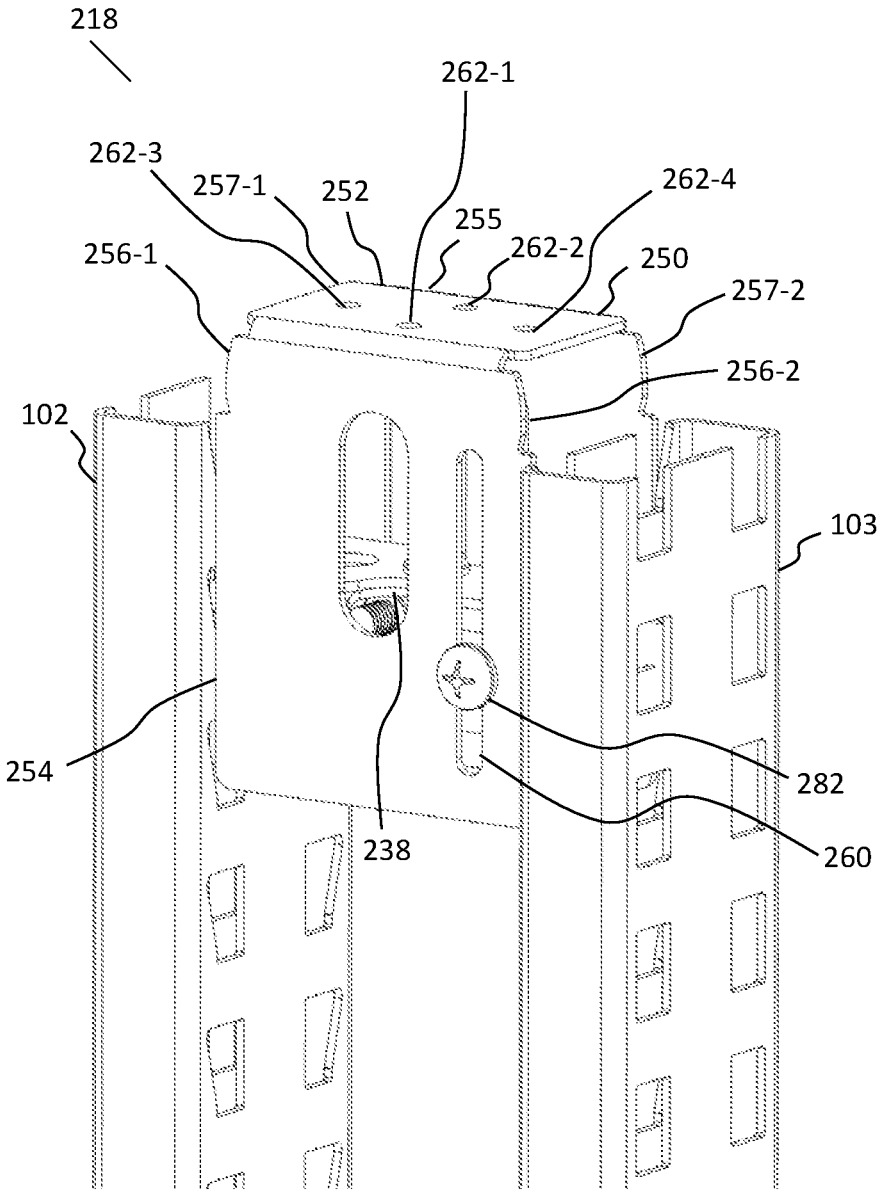
FIG. 17 illustrates a perspective view of a top connector assembly attached to two uprights according to an example of the principles described herein.

Assembly of the retainer plate 238 and lower bracket 220 and further including the holder member 250 is shown in FIG. 17. Holes on the lower bracket 220, retainer plate 238, and holder member 250 are aligned for alignment and securement to top crossbar 236 (see FIG. 17). Particularly, corner holes 226 and 227 of lower bracket 220 align with cutouts 246 and 247 of retainer plate 238 which allow access to holes 262-1 and 262-2 of holder member 250. Side holes 224 and 225 of lower bracket 220 align with side holes 242 and 243 of the retainer plate 238 and allow access to holes 262-3 and 262-4 of holder member 250. This access allows securement together of the lower bracket 220, retainer plate 238, and holder member 250 with locking structures such as screws (not shown) to top crossbar 236 (see FIG. 17).

Access hole 232 aligns with side slot 260 of holder member 250 and is used to adjust the height of the holder member with a screw tightening the holder member 250 through the hole 232 to a desired position along the slot 260. A screw 282 on the lower bracket 220 is to be slidably engaged to side slot 260, thus allowing the holder member 250 to be slidably engaged to the lower bracket 220 and be raised and lowered relative to the stud assembly 124. Top panel 252 of the holder member 250 may have a variable effective height due to the flexible positioning afforded by the side slot 260 and which may thus span a substantial height of the side panel 254. Center slot 258 is an access hole for additional securement of the retainer plate 238 to the lower bracket 220 by locking structures such as screws.

FIG. 17 illustrates all three components working together with uprights 102 and 103. Side panels 254 and 255 extend downward on sides of the retainer plate 238 and lower bracket 220. The exact position of the side panels 254 and 255 relative to the retainer plate 238 and the lower bracket 220 is determined by locking the side panel 254 to the access hole 232 of the lower bracket 220 with a screw (not shown). In an example, an access hole is present on the opposite side of the lower bracket 220, and the same type of locking securement to the access hole is used.

Figure 18:
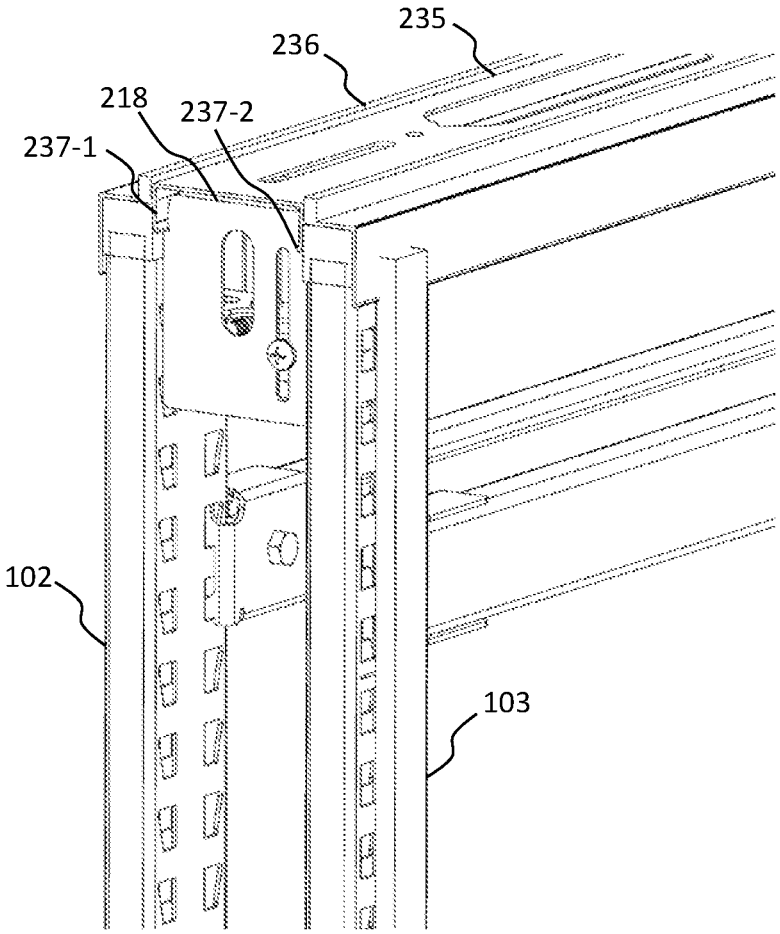
FIG. 18 illustrates a perspective view of a top connector assembly and top crossbar attached to a wall system according to an example of the principles described herein.

FIG. 18 illustrates a top portion of a wall system with all three components (i.e. lower bracket 220, retainer plate 238, and holder member 250) of a top connector assembly 218 between uprights 102 and 103. A top crossbar 236 that lays on top of the holder member 250 is raised and lowered by the holder member 250. The top crossbar 236 includes generally straight sidewalls 237-1, -2 that extend downward from side edges of a generally flat elongate member 235. Free ends of the sidewalls 237-1, -2 curve inward toward a central long axis of the elongate member 235 and may be resilient to be forced open and return toward their original shape to clip onto curved shoulders 256-1, -2, and 257-1, -2 of holder member 250 and thus be retained. A screw or other locking structure may be used to provided additional securement of the top crossbar 236 to the top connector assembly 218 as desired or needed. In an example, the top crossbar 236 and the base track 208 are identical in structure and form and face each other in a mirror like configuration when assembled on the wall system.

Figure 19:
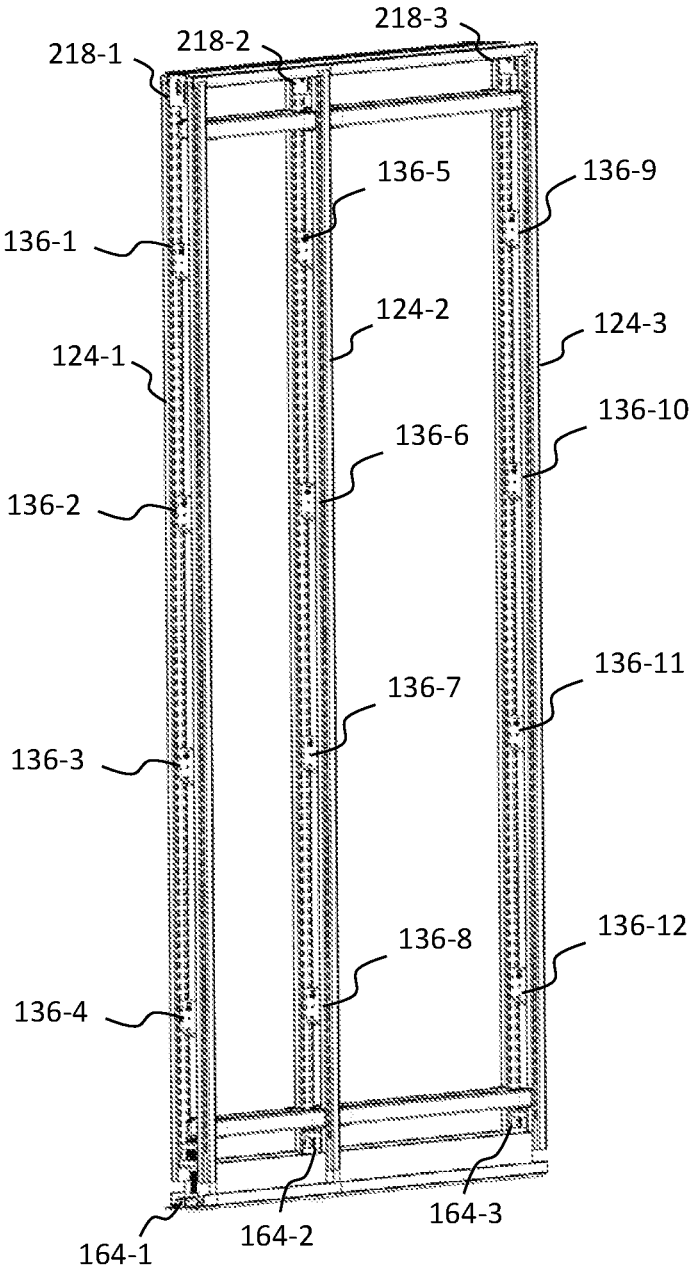
FIG. 19 illustrates a perspective view of a wall system without cladding according to an example of the principles described herein.

FIG. 19 illustrates the aforementioned assemblies discussed, including upright assemblies 124-1, -2, -3, bracket assemblies 136-1, -2, -3, -4, -5, -6, -7, -8, -9, -10, -11, -12, leveler assemblies 164-1, -2, -3, and top connector assemblies 218-1, -2, -3. With these assemblies, cladding can be attached to complete the outer appearance of the wall system 100. In addition, sound proofing and electrical installation can be performed to make the wall system 100 fully usable.

Figure 20:
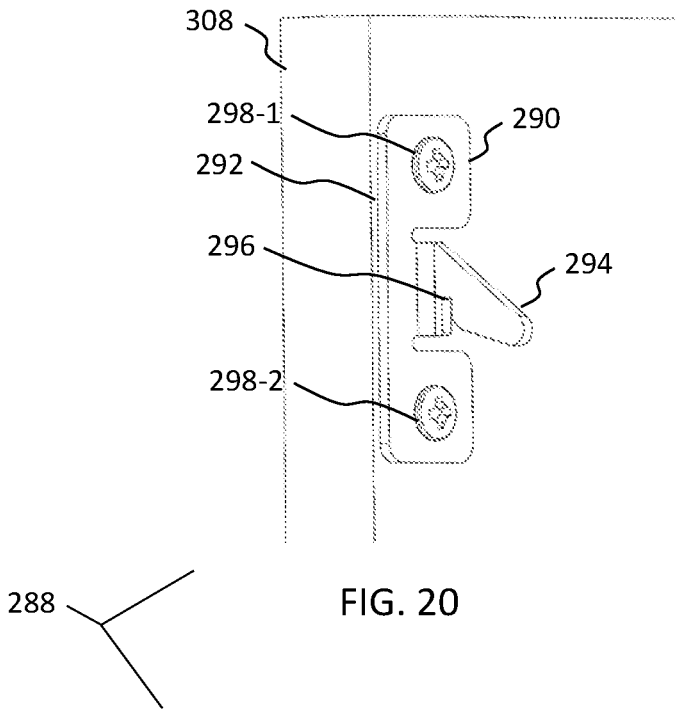
FIG. 20 illustrates a perspective view of a top hanger of a hanger assembly according to an example of the principles described herein.
Figure 21:
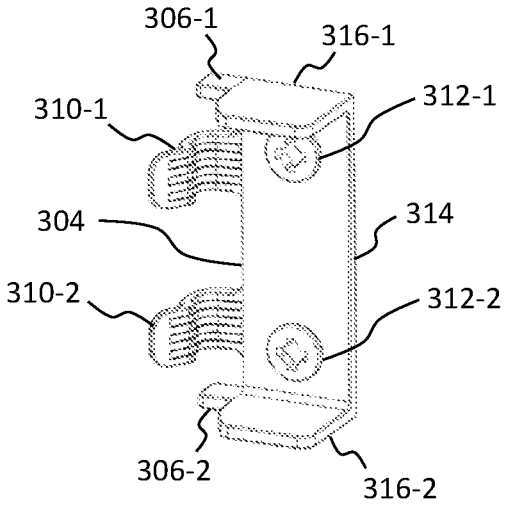
FIG. 21 illustrates a perspective view of a side hanger of a hanger assembly according to an example of the principles described herein.

Cladding 308 is attached to the wall system 100 with a hanger assembly 288. The hanger assembly 288 includes a top hanger 290 as shown in FIG. 20 and a side clip 304 as shown in FIG. 21. Cladding includes any type of panel, board, sheetrock, or other type of wall covering that can be removably affixed to the upright assemblies 124. In an example, a hanger assembly 288 is used to hang cladding 308. The hanger assembly 288 shown includes a top hanger 290 and a side hanger 304. The top hanger 290 is affixed at or near top corners of the cladding 308 while the side hanger 304 is affixed at or near sides and bottom corners of the cladding 308.

The top hanger 290 includes a generally flat main body 292 with top and bottom screws and screw holes 298-1, -2. Protruding from a central area of the main body 292 is a nose member 294, a triangular like flat planar member that extends perpendicularly away from the main body 292. The nose member 294 further includes a notch 296 to attach to an aperture of an upright and thereby secure the cladding to the upright.

Like the top hanger 290, the side hanger 304 also includes a main body 314. Extending from sides of the main body 314 are dual side clips 310-1, -2. Each clip 310-1, -2 includes a curved, hook-like member with resilient properties to be forced open and then elastically return toward its original shape and position. Screws 312-5, -6 affix the side hanger 304 through respective top and bottom screw holes 312-1, -3 to cladding 308. The clips 310-1, -2 are to be inserted within apertures, such as outer facing rectangular apertures 158-1, -2 and 159-1, -2 (see FIG. 6) on outer facing uprights 102 and 103, and hook over an outer edge on the outer facing upright 102 and 103. In this manner, the side hanger 304 affixes the cladding 308 to the stud. At a top and bottom side of the main body 314 are side flanges 316-1, -2 which are generally flat planar members that extend perpendicularly away from the main body 314. Side flanges 316-1, -2 abut against an upright to provide an appropriate space between the side hanger 304 and an upright for the cladding to be placed. Ledges 306-1, -2 on the side hanger 304 include small flat extensions members that extend in a co-planar and co-existential manner with side flanges 316-1, -2 toward the same side as the side clips 310-1, -2. Ledges 306-1, -2 are to offset the clips 310-1, -2 from an upright 102 or 103.

Figure 22:
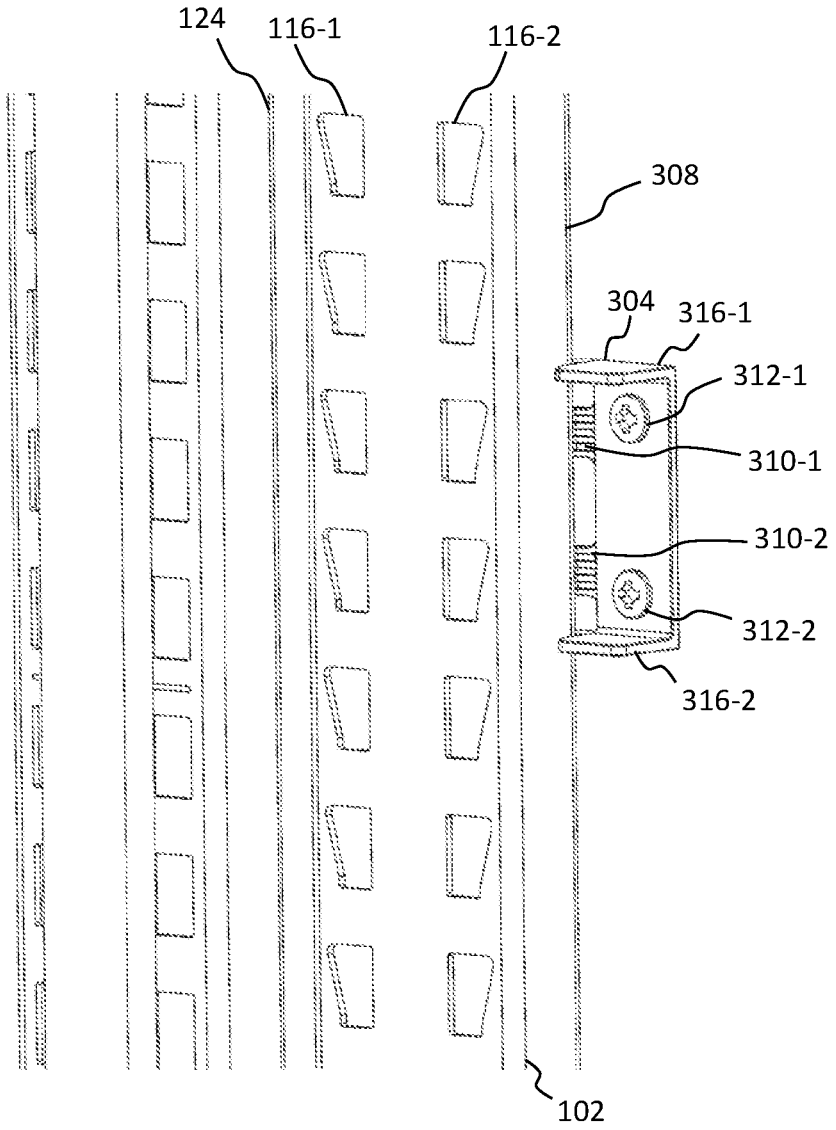
FIG. 22 illustrates a perspective view of cladding attached to a stud assembly with a side hanger according to an example of the principles described herein.

FIG. 22 illustrates a side hanger 304 attached to upright 102 of stud assembly 124. Clips 310-1, -2 are inserted in rectangular apertures (not visible) that are located on the opposite side of upright 102 as shown and thus face in an opposite direction to apertures 116-1, -2 of upright 102. Holes and screws 312-1, -2 attach side hanger 304 to cladding 308 and thus securing the cladding 308 to upright 102.

Figure 23:
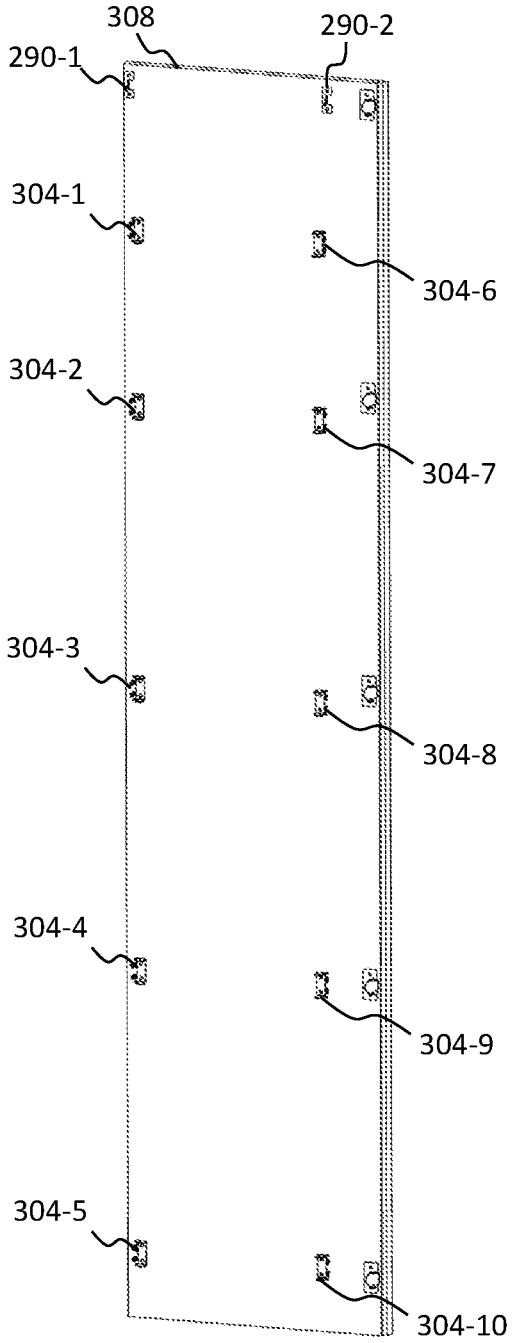
FIG. 23 illustrates a perspective view of cladding attached to a wall system with a hanger assembly according to an example of the principles described herein.

FIG. 23 illustrates an example cladding 308 with multiple top hangers 290-1, -2 and side hangers 304-1, -2, -3, -4, -5, -6, -7, -8, -9, -10 attached in preparation for securing the cladding 308 to studs. The top hangers 290-1, -2 are located at or near corners of a top of the cladding 308. The side hangers 304-1, -2, -3, -4, -5 are located along side edges while side hangers 304-6, -7, -8, -9, -10 are offset from side edges to accommodate a given spacing between studs.

Figure 24:
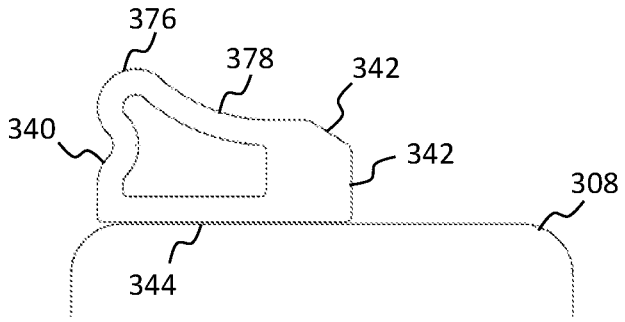
FIG. 24 illustrates a side view of a block and cladding according to an example of the principles described herein.

FIG. 24 shows an example block 376 that can be used in between cladding, around side edges of uprights and stud assemblies, and on other locations to isolate noise and prevent sound travel. Example block 376 includes an elongated member that may be made of an acoustical foam or other material with acoustic properties. Block 376 includes a curved top 378 that angles upward on an outer side that faces an outer facing side of cladding 308. The curved top 378 cups around outer edges of the block 376 so as to more fully engage a cladding that tops the cladding 308 shown and make the engagement air tight. Undulating side 340 of block 376 includes an S-shape curvature or other curvature to allow the block 376*b* to contract and provide give for engaging a top cladding. The opposite side includes a straight side 342 which is a thicker member that is generally thicker to provide a sound barrier and support the top cladding. On top of the straight side 342 is an angled side 342 which is an angled top portion of the straight side 342 and which allows space for support of a top cladding.

Figure 25:
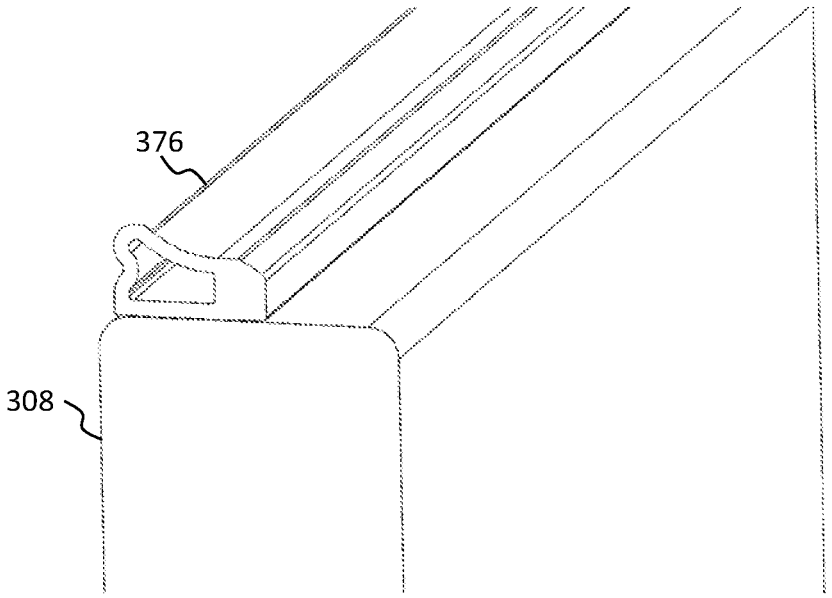
FIG. 25 illustrates a perspective view of a block and cladding according to an example of the principles described herein.

FIG. 25 shows another view of the block 376 on cladding 308. The block 376 has a thickness that is approximately half the width of the cladding 308. The thickness may be more or less in examples.

Figure 26A:
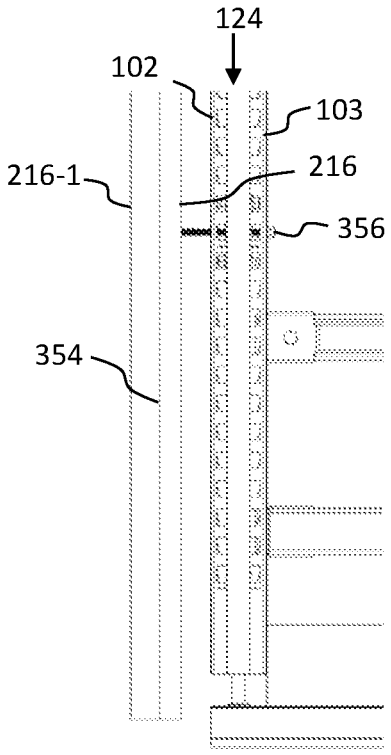
FIG. 26*a* illustrates a side view of two blocks and cladding attached to a stud assembly according to an example of the principles described herein.
Figure 26B:
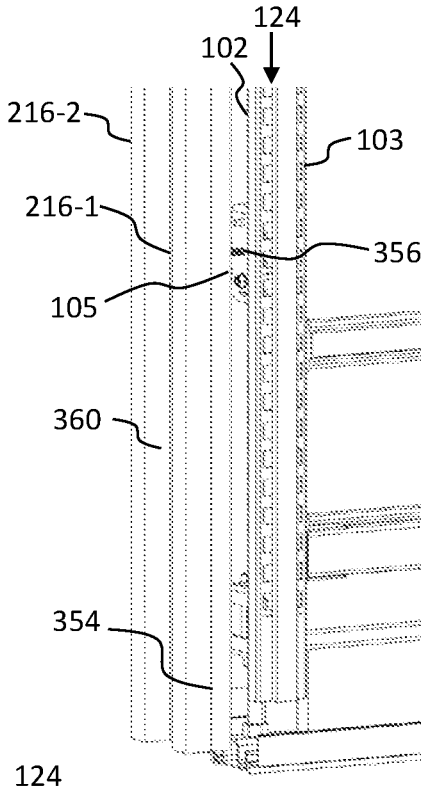
FIG. 26*b* illustrates a perspective view of two blocks and cladding attached to a stud assembly according to an example of the principles described herein.
Figure 26C:
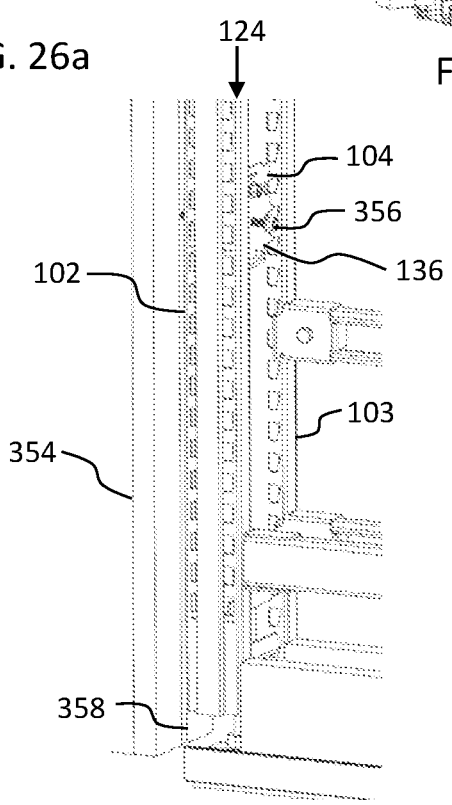
FIG. 26*c* illustrates a perspective view of two blocks and cladding attached to a stud assembly according to an example of the principles described herein.

FIG. 26*a* shows a side view of two claddings with only the first cladding 216-1 visible and a rigid board 354 attached to a first upright 102. FIG. 26*b* shows a perspective view with the second cladding 216-2 visible. FIGS. 26*b* and 26*c* show perspective views also of the two blocks 216-1, -2 attached to a rigid board 354 that is attached to a first upright 102. The two blocks 216-1, -2 include elongated blocks that are placed side by side with a gap space 360 in between them. The gap space 360 provides a dead air space for sound insulation. Each cladding to be mounted on each side of the stud assembly 124 includes a respective block 216-1, -2 for isolating the cladding and thus a dual seal, or in other words, a seal on both sides of the stud assembly 124, is provided.

The rigid board 354 in between the blocks 216-1, -2 includes a generally flat elongated member that spans a width that is at least the width of the two blocks 216-1, -2 plus the gap space 360. The rigid board 354 further includes an indentation 358 along the vertical length of the rigid board 354. An adjusting bolt 356 goes through holes 154-2, 155-2 (see FIG. 5) in the bracket assembly 136 and within the indentation 358 to tighten the rigid board 354 and the two blocks 216-1, -2 attached to the rigid board 354, to the first upright 102 of the stud assembly 124.

Figure 27:
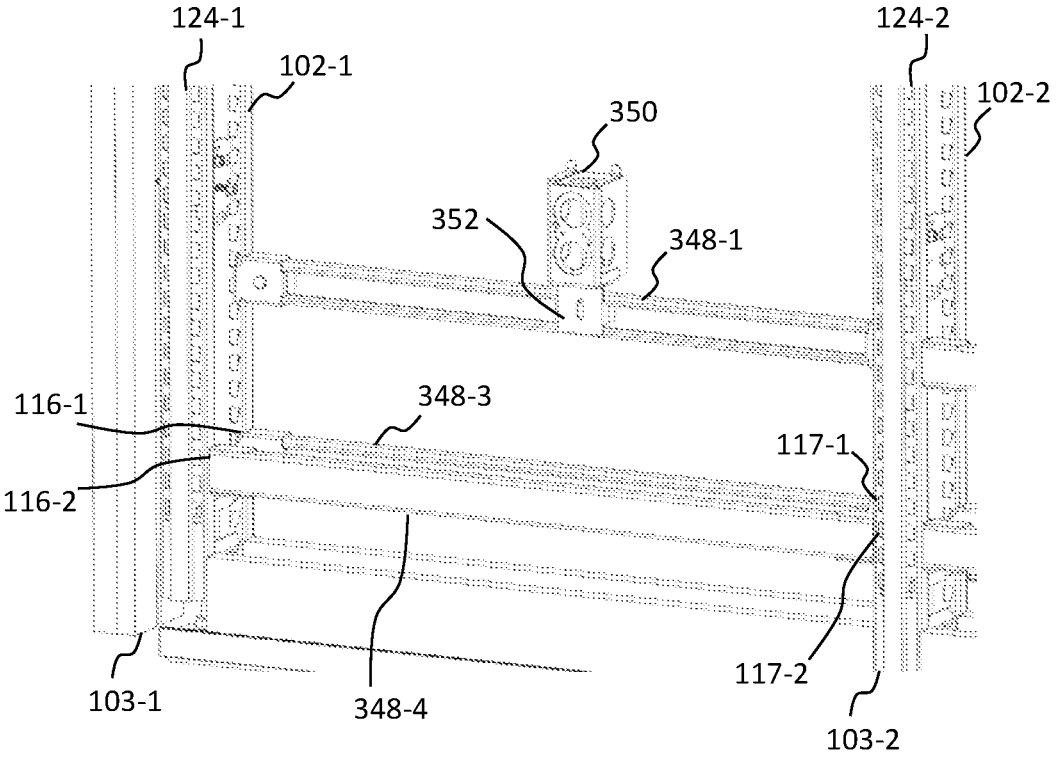
FIG. 27 illustrates a perspective view of a stud assembly with connector bars according to an example of the principles described herein.

FIG. 27 illustrates connector bars 348-1, -3, -4 that connects two stud assemblies 124-1 and 124-2. Connector bar 348-1, -3 attaches to apertures 116-1 and 117-1. Connector bar 348-4 attaches to apertures 116-2 and 117-2. Various structures such as a fitting 352 that attaches to connector bar 348-4 can be used for securing items such as the electrical outlet 350. As shown below, two connector bars 348-3 and 348-4 are used together at the same height level to provide a dual connection between the stud assemblies 124-1 and 124-2.

Figure 28:
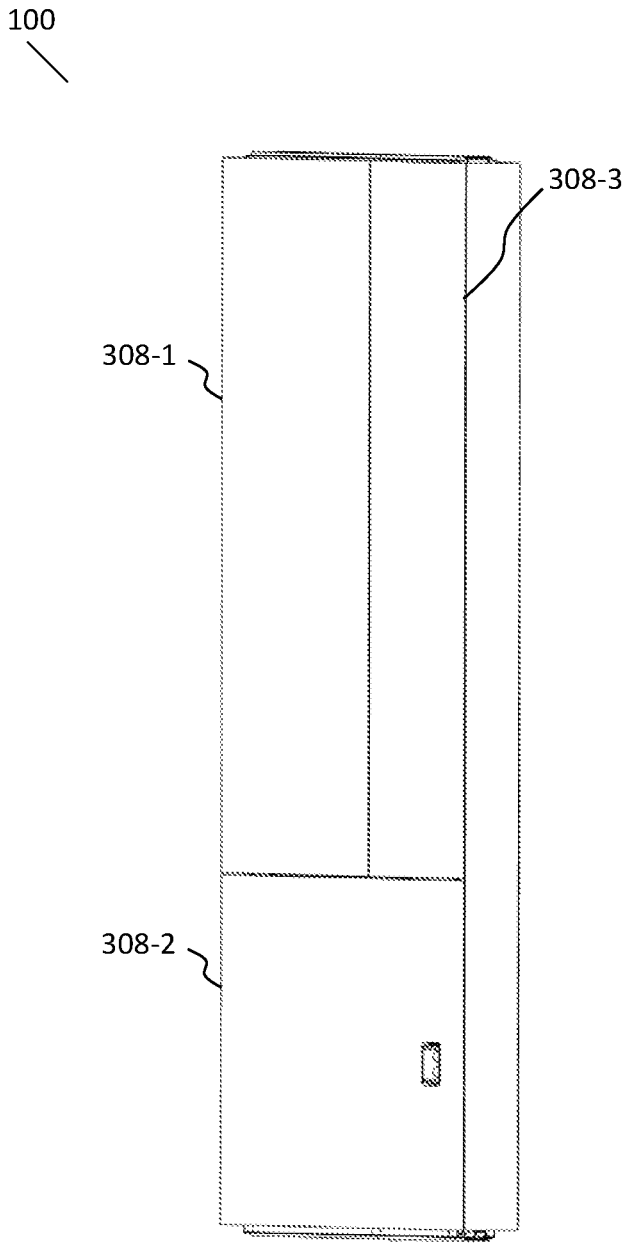
FIG. 28 illustrates a front view of a wall system according to an example of the principles described herein.

FIG. 28 illustrates an implementation of a wall system 100 with cladding 308-1, -2 and blocks 376-1, -2. Cladding 308-1, -2 is stacked and layered with blocks 376-1, -2 in between each cladding 308-1, -2. The layered wall system 100 allows a modular fit as well as various designs and aesthetic appearances with different types of cladding being used in the wall system 100.

The descriptions of the various examples of the present disclosure have been presented for purposes of illustration, but are not intended to be exhaustive or limited to the examples disclosed. Many modifications and variations will be apparent to those of ordinary skill in the art without departing from the scope and spirit of the described examples. The terminology used herein was chosen to best explain the principles of the examples, the practical application or technical improvement over technologies found in the marketplace, or to enable others of ordinary skill in the art to understand the examples disclosed herein.

What is claimed is:

1. A wall system, comprising:

a first and second upright each having an elongate member;

a plurality of apertures spaced on a side surface along a longitudinal length of each of the first and second upright;

first and second web brackets, each said web bracket includes a central body with an extension arm on opposing sides;

a notch at a free end portion of each extension arm; and a stud assembly defined by the first upright connected to the second upright by a respective said web bracket, each notch of the respective web bracket removably inserted over an edge of a respective aperture of the plurality of apertures of the first and second uprights.

2. The wall system of claim 1, wherein the first and second upright further comprise a hollow therethrough along the longitudinal lengths of the respective elongate members, the hollow of each elongate member having a rectangular cross section.

3. The wall system of claim 1, wherein the web brackets further comprise a plurality of extension arms that are symmetrically arranged on either side of the central body and positioned such that notches on the plurality of extension arms are removably inserted over edges of respective apertures of the plurality of apertures on the first and second uprights to define the stud assembly.

4. The wall system of claim 1, wherein the plurality of apertures are arranged in pairs, the plurality of apertures located along side walls of the first and second uprights that face each other, the pairs of apertures being spaced in vertical increments to facilitate a variety of sizes and positions of the web brackets.

5. The wall system of claim 1, further comprising a top connector assembly that comprises:

a lower bracket that spans a width between the first and second uprights, notches on opposite ends of the lower bracket to engage respective apertures of the plurality of apertures on the first and second uprights;

a retainer plate that includes a planar member to lay flush on a top surface of the lower bracket, free ends of the retainer plate having side arms that attach to respective apertures of the plurality of apertures on the stud assembly; and a holder member with side arms to partially surround the lower bracket and retainer plate, the side arms having a slot in which a screw on the lower bracket is to be slidably engaged, thus allowing the holder member to be slidably engaged to the lower bracket and be raised and lowered relative to the stud assembly.

6. The wall system of claim 1, further comprising a leveler assembly located between the first and second uprights, the leveler assembly to removably attach to the first and second uprights at respective apertures of the plurality of apertures, the leveler assembly including a threaded rod to raise and lower the first and second uprights relative to a base of the leveler assembly and thereby adjust a relative height of the stud assembly.

7. The wall system of claim 6, wherein the leveler assembly further comprises a support bracket that spans a width between the first and second uprights, notches on opposite ends of the support bracket to engage respective apertures of the plurality of apertures on the first and second uprights, a central hole centrally located on the support bracket to allow the threaded rod to be rotatably engaged to thereby raise and lower the first and second uprights.

8. The wall system of claim 7, further comprising a base track that comprises:

a substantially flat elongate member;

a stepped platform that runs along either side edge of the elongate member, the stepped platform having a flat surface on which the first and second upright is to be supported;

a divider wall between the elongate member and each stepped platform, each divider wall being a flat member that extends perpendicularly away from the side edges of the elongate member, free ends of each divider wall curving or otherwise bending inward toward a central long axis of the stepped platform, the free ends having resilient properties so as to be forced apart and then elastically returned to original shape to thereby allow the leveler assembly to be inserted and retained within the base track.

9. The wall system of claim 1, further comprising an attachment structure to interlock the first web bracket and the second web bracket together and form a bracket assembly, the bracket assembly to attach the first and second uprights in a manner that prevents the first and second uprights from moving in three axes.

10. The wall system of claim 9, wherein the attachment structure includes at least one of screw fittings, slots, and inserts.

11. The wall system of claim 4, wherein the first and second web brackets each include a slot on one end and an insert on an opposite end, the bracket assembly formed by the insert of the first bracket being inserted within the slot of the second web bracket and the insert of the second bracket being inserted within the slot of the first web bracket.

12. The wall system of claim 11, wherein:

the first and second web bracket interlock together in an inverted position so as to mirror each other but with the second web bracket rotated upside down relative to the first web bracket;

notches on the first web bracket align with upper edges of respective apertures of the plurality of apertures on the first and second uprights; and notches on the second web bracket align with lower edges of respective apertures of the plurality of apertures on the first and second uprights.

13. A wall system, comprising:

a first and second upright that define a stud assembly;

a lower bracket that spans a width between the first and second uprights, notches on opposite ends of the lower bracket configured to engage respective apertures of a plurality of apertures on the first and second uprights;

a top connector assembly that attaches to a top portion of the first and second uprights, the top connector assembly having a holder member to be raised and lowered relative to the stud assembly to effectively extend a top of the stud assembly; and a leveler assembly that attaches to a bottom portion of the first and second uprights, the leveler having a threaded rod to raise and lower the first and second uprights relative to a base of the leveler to thereby adjust a relative height of the stud assembly.

14. The wall system of claim 13, further comprising:

a base track having a raised base on which the stud assembly is placed, the base track having a planar member with a raised base that runs along either side of the elongate member, each raised base having a flat surface on which the first and second upright is to be supported; and a divider wall between the elongate member and each of the raised bases, each divider wall being a flat member that extends perpendicularly away from side edges of the elongate member, free ends of each divider wall curving or otherwise bending inward toward a central long axis of the raised base, the free ends having resilient properties so as to be forced apart and then elastically returned to original shape to thereby allow the leveler to be inserted and retained within the base track.

15. The wall system of claim 13, further comprising a block located on at least one outer edge of cladding or in between two claddings, the block having acoustic properties to isolate sound.

16. The wall system of claim 13, further comprising a first and second web bracket that interlock together to form a bracket assembly, the bracket assembly to attach the first and second uprights in a manner that prevents the first and second uprights from moving in three axes.

17. The wall system of claim 16, wherein:

the first and second web bracket interlock together in an inverted position so as to mirror each other but with the second web bracket rotated upside down relative to the first web bracket;

the first and second web brackets are attached by an attachment structure so as to stay in place;

notches on the first web bracket align with upper edges of respective apertures of the plurality of apertures of first and second uprights; and notches on the second web bracket align with lower edges of respective apertures of the first and second uprights.

18. The wall system of claim 13, further comprising a hanger assembly to secure cladding components to the stud assembly, the hanger assembly including at least one side hanger that has resilient arms to be forced away from a neutral position to be inserted within respective apertures of the plurality of apertures on a first or second upright and are retained by elastically returning toward the neutral position once no longer forced apart.

19. The wall system of claim 18, the hanger assembly comprising:

a top hanger comprising:

a main body;

a nose member that extends from the main body; and a notch in the nose member to attach to an aperture of the plurality of apertures of the first or second upright; and a side clip comprising:

a flat planar member;

side clips that extend from a side of the flat planar member, the side clips having resilient properties that allow the side clips to be forced away from original shape and removably inserted within respective apertures of the plurality of apertures and then elastically returned toward the original shape to be retained within the respective apertures; and an attachment structure to secure the side clip to cladding.

20. A wall system, comprising:

a stud assembly, comprising:

a first and second upright;

a plurality of apertures spaced on a side surface along respective longitudinal lengths of the first and second uprights;

a web bracket that includes a central body with an extension arm on opposing sides; and a notch at or near a free end of each extension arm, a stud assembly formed by the first upright connected to the second upright by the web bracket, each notch of the web bracket removably inserted over an edge of a respective aperture of the plurality of apertures of the first and second uprights, a top connector assembly, comprising:

a top connector that attaches to a top portion of the first and second uprights, the top connector assembly having a holder member to be raised and lowered relative to the stud assembly to effectively extend a top of the stud assembly; and a leveler assembly, comprising:

a leveler foot that attaches to a bottom portion of the first and second uprights; and a threaded rod attached to the leveler foot and the stud assembly, the threaded rod to raise and lower the first and second uprights relative to the leveler foot to thereby adjust a relative height of the stud assembly.

* * * * *